US012674317B2

(12) United States Patent
Quist et al.

(10) Patent No.: US 12,674,317 B2
(45) Date of Patent: Jul. 7, 2026

(54) SET OF BUILDING PANELS COMPRISING A LOCKING DEVICE

(71) Applicant: Välinge Innovation AB, Viken (SE)

(72) Inventors: Karl Quist, Höganäs (SE); Christian Boo, Kågeröd (SE); Per Nygren, Ramlösa (SE)

(73) Assignee: VÄLINGE INNOVATION AB, Viken (SE)

( * ) Notice: Subject to any disclaimer, the term of this patent is extended or adjusted under 35 U.S.C. 154(b) by 172 days.

(21) Appl. No.: 18/407,549

(22) Filed: Jan. 9, 2024

(65) Prior Publication Data

US 2024/0229452 A1 Jul. 11, 2024

(30) Foreign Application Priority Data

Jan. 10, 2023 (SE) ..... 2350010-1
Jan. 10, 2023 (SE) ..... 2350011-9

(51) Int. Cl.
*E04B 1/61* (2006.01)
*E04F 15/02* (2006.01)
*E04F 15/024* (2006.01)

(52) U.S. Cl.
CPC ..... *E04B 1/6116* (2013.01); *E04F 15/02038* (2013.01); *E04F 15/02464* (2013.01);
(Continued)

(58) Field of Classification Search
CPC ..... E04B 1/6116; E04B 2001/6195; E04F 15/02038; E04F 15/02464; E04F 15/0215;
(Continued)

(56) References Cited

U.S. PATENT DOCUMENTS 8,037,656 B2 * 10/2011 Liu ..... E04F 15/02 52/592.1
2009/0049787 A1 * 2/2009 Hannig ..... E04F 15/107 52/589.1
(Continued)

FOREIGN PATENT DOCUMENTS

CA 2844818 A1 * 3/2013 ..... B26D 1/14
DE 202008011589 U1 * 11/2008 ..... E04F 15/02038
(Continued)

OTHER PUBLICATIONS

U.S. Appl. No. 18/967,739, Anders Nilsson, filed Dec. 1, 2024.
(Continued)

*Primary Examiner* — Brent W Herring
(74) *Attorney, Agent, or Firm* — Boone IP Law

(57) ABSTRACT

A set of building panels including a locking device for locking a first edge portion of a first panel to a second edge portion of a second panel. The locking device includes a locking element extending upwards from a lower strip provided in the first edge portion, and a locking member extending downwards from an upper strip provided in the second edge portion, wherein the locking element and the locking member are configured to cooperate for horizontal locking. The locking device further includes a protrusion and a groove configured to cooperate for vertical locking. A perpendicularly arranged fourth edge portion of the second panel includes a tongue configured to cooperate with a tongue groove of an adjacent panel for vertical locking. The protrusion extends inwardly of the tongue in a direction along the second edge portion.

18 Claims, 9 Drawing Sheets

(52) U.S. Cl.
CPC ..... *E04B 2001/6195* (2013.01); *E04F 2015/02088* (2013.01); *E04F 2015/02094* (2013.01); *E04F 15/0215* (2013.01); *E04F 2201/0146* (2013.01); *E04F 2203/065* (2013.01)

(58) Field of Classification Search
CPC .. E04F 2015/02088; E04F 2015/02094; E04F 2201/0146; E04F 2203/065; E04F 15/105
See application file for complete search history.

(56) References Cited

U.S. PATENT DOCUMENTS

| | | | | |
|---|---|---|---|---|
| 2010/0031594 | A1* | 2/2010 | Liu | E04F 15/02194 52/592.1 |
| 2011/0138722 | A1* | 6/2011 | Hannig | E04F 15/02033 52/309.1 |
| 2012/0073235 | A1 | 3/2012 | Hannig | |
| 2015/0240500 | A1 | 8/2015 | Stevens | |
| 2016/0333595 | A1* | 11/2016 | Cappelle | E04F 15/105 |
| 2017/0067261 | A1 | 3/2017 | Hannig | |
| 2017/0284105 | A1 | 10/2017 | Ceysson | |
| 2018/0002935 | A1* | 1/2018 | Devos | B32B 27/08 |
| 2019/0017278 | A1* | 1/2019 | De Rick | E04F 15/105 |
| 2019/0271164 | A1 | 9/2019 | Devos | |
| 2020/0318360 | A1 | 10/2020 | De Rick | |
| 2021/0062517 | A1* | 3/2021 | Markovski | E04F 15/02038 |
| 2021/0198901 | A1 | 7/2021 | Josefsson | |
| 2021/0381256 | A1 | 12/2021 | Ceysson | |
| 2022/0243482 | A1 | 8/2022 | Landgård | |
| 2023/0015897 | A1* | 1/2023 | Markovski | E04F 15/02038 |

FOREIGN PATENT DOCUMENTS

| | | | | |
|---|---|---|---|---|
| EP | 1169528 | A1 | 1/2002 | |
| EP | 1350904 | A2 * | 10/2003 | E04F 15/04 |
| EP | 3460143 | A1 | 3/2019 | |
| WO | 01/66876 | A1 | 9/2001 | |
| WO | 2007015669 | A2 | 2/2007 | |
| WO | 2012101171 | A1 | 8/2012 | |
| WO | 2013/151494 | A1 | 10/2013 | |
| WO | 2017105335 | A1 | 6/2017 | |
| WO | 2018063047 | A1 | 4/2018 | |
| WO | 2019145521 | A1 | 8/2019 | |
| WO | 2021118448 | A1 | 6/2021 | |
| WO | 2022269402 | A1 | 12/2022 | |

OTHER PUBLICATIONS

U.S. Appl. No. 18/907,818, Richard William Kell, filed Oct. 7, 2024.
U.S. Appl. No. 17/716,622, Anders Nilsson, filed Apr. 8, 2022.
U.S. Appl. No. 17/825,654, Roger Ylikangas, filed May 26, 2022.
U.S. Appl. No. 17/842,122, Christian Boo, filed Jun. 16, 2022.
U.S. Appl. No. 18/057,811, Darko Pervan, filed Nov. 22, 2022.
U.S. Appl. No. 18/176,003, Richard William Kell, filed Feb. 28, 2023.
U.S. Appl. No. 18/309,118, Christian Boo, filed Apr. 28, 2023.
U.S. Appl. No. 18/223,091, Roger Ylikangas, filed Jul. 18, 2023.
U.S. Appl. No. 18/631,407, Darko Pervan, filed Apr. 10, 2024.
International Search Report and Written Opinion received for PCT Patent Application No. PCT/SE2024/050013 , mailed on Jan. 26, 2024, 22 pages.
U.S. Appl. No. 19/209,043, Roger Ylikangas, filed May 15, 2025.
Swedish Official Action and Search Report mailed on Aug. 30, 2023, by the Swedish Patent and Registration Office for Swedish Application No. 2350011-9, 11 pages.
Swedish Official Action and Search Report mailed on Sep. 4, 2023, by the Swedish Patent and Registration Office for Swedish Application No. 2350010-1, 11 pages.
U.S. Appl. No. 19/312,513, Roger Ylikangas, filed Aug. 28, 2025.

* cited by examiner

SET OF BUILDING PANELS COMPRISING A LOCKING DEVICE

CROSS REFERENCE TO PRIORITY APPLICATIONS

The present application claims the benefit of Swedish Application No. 2350010-1, filed on Jan. 10, 2023, and Swedish Application No. 2350011-9, filed on Jan. 10, 2023. The entire contents of each of Swedish Application No. 2350010-1 and Swedish Application No. 2350011-9 are hereby incorporated herein by reference in their entirety.

TECHNICAL FIELD

The disclosure generally relates to a set of building panels, such as floor panels or wall panels, comprising a locking device. More specifically, edge portions of adjacent panels in the set are configured to be joined to each other by a relative essentially vertical displacement of the panels against each other.

BACKGROUND

The fold-down locking system disclosed in, e.g., WO 2007/015669 provides a fast, time efficient and easy single action installation method that has revolutionized the flooring industry. By using a separate flexible tongue for vertical locking of adjacent floor panels, this type of locking system may provide strong interlocking of floor panels for a variety of panel material choices and formats.

For certain applications or material choices, such as for a Luxury Vinyl Tile (LVT tile), a Stone Plastic (Polymer) Composite panel or Solid Polymer Core panel (SPC panel), or an Expanded Polymer Core panel (EPC panel), also known as Water Proof Core panel or Wood Plastic Composite panel (WPC panel), it may be advantageous to utilize a locking system where the tongue used for the vertical locking is formed in one piece with the floor panel. Such locking systems are described in the disclosure WO 2018/063047 and may provide strong locking of the panels and a fast and easy installation of them.

WO 2019/145521 discloses a joining system for floor panels comprising a rigid and non-resilient female coupling recess formed in a first floor panel, wherein the female coupling recess is adapted to receive a resilient male coupling tongue projecting from an adjoining second floor panel in a direction perpendicular to a main floor surface plane in which the floor panels are laid. The joining system includes an elasticity slot for facilitating resilient movement in the vertical snap joint interlocking engagement.

However, the design of some of the known joining systems may make it difficult to ensure that the joined panels become correctly positioned. This may be especially cumbersome when the panels comprise a thermoplastic material, such as PVC, and a high degree of mineral filler, such that the panels become rigid, for example SPC panels, or when the panels comprise an HDF core. Moreover, at least for some applications, such as for panels comprising an HDF core, the robustness of the known joining systems may be unsatisfactory.

SUMMARY

It is therefore an object of at least certain embodiments of the present disclosure to provide a set of building panels, such as floor panels, whose joining is more controlled.

Another object of at least certain embodiments of the present disclosure is to provide a set of building panels, such as floor panels, with an increased vertical locking strength.

These and other objects and advantages that will be apparent from the description have been achieved by the various aspects, embodiments and examples described below.

In accordance with the disclosure herein, there is provided a set of building panels, such as floor panels, comprising a first panel and a second panel and a locking device for locking a first edge portion of the first panel to a second edge portion of the second panel. The first and second edge portions are configured to be joined to each other by a relative essentially vertical displacement of the first and second panels against each other. The locking device comprises a locking element extending upwards from a lower strip provided in the first edge portion, and a locking member extending downwards from an upper strip provided in the second edge portion, wherein the locking element and the locking member are configured to cooperate for horizontal locking of the first and second edge portions. The locking device further comprises a protrusion and a groove arranged in the first and second edge portions, wherein the protrusion and the groove are configured to cooperate for vertical locking of the first and second edge portions.

Generally herein, cooperating surfaces, members or elements, etc., may cooperate by direct engagement or indirect engagement. Examples of such cooperating surfaces or elements include the upper cooperating surfaces of the protrusion and groove, inner portions of the locking element and locking member, overlapping cooperating surfaces of a shelf portion and a lap portion, upper portions of the first and second edge portions, etc. In any embodiment described herein, there may be a sealing agent, such as a wax or an adhesive, provided between the cooperating surfaces, thereby providing examples of an indirect engagement.

The relative essentially vertical displacement preferably comprises a folding displacement, or equivalently, scissor displacement (so-called fold down), whereby the second edge portion is gradually vertically displaced towards the first edge portion along a longitudinal extension of the edge portions. Thereby, the first and second edge portions may be locally locked in a first side section of the edge portions while the second edge portion may be arranged at an angle with respect to the first edge portion in a second side section. The first and second edge portions may thereafter become locally locked also in the second side section by further vertically displacing the second edge portion against the first edge portion towards lower angles at the second side section until the front sides of the first and second panels are substantially arranged along the same horizontal plane. Preferably, the first and second edge portions are locked to each other by means of a snapping engagement, e.g., whereby the protrusion snaps into the groove.

The protrusion may protrude, preferably horizontally, outwards from the second edge portion and the groove may be arranged in the first edge portion.

A perpendicularly arranged fourth edge portion of the second panel may comprise a further locking device comprising a tongue configured to cooperate with a tongue groove of an adjacent panel for vertical locking. Alternatively, or additionally, a perpendicularly arranged fourth edge portion of the second panel may comprise a further locking device comprising a further locking groove configured to cooperate with a further locking element provided on a further strip of an adjacent panel for horizontal locking.

The protrusion may extend inwardly of the tongue in a direction along the second edge portion, such as inwardly of a tip of the tongue. This may be embodied in a locked and/or an unlocked state of the first and second panels. By extending inwardly of the tongue, a longitudinally outermost portion of the protrusion may extend inwardly of the tongue, such as the tip of the tongue, along the second edge portion. For example, a longitudinally outermost portion of the protrusion may be longitudinally inside of a longitudinal end of the second edge portion, wherein the longitudinal end of the second edge portion preferably is defined by a tip of the tongue. Thereby, at least a section of the protrusion may be missing from a corner portion of the second panel, where the second and fourth edge portions meet. As a consequence, the first and second edge portions may be joined to each other by means of a folding displacement in a more controlled manner. In some embodiments, this configuration is even necessary. Moreover, this configuration may be particularly useful, or sometimes even required, when implementing a contacting joining position and/or a locking joining position (described elsewhere herein) of the panels in a corner portion of the second panel.

The longitudinally outermost portion of the protrusion may be longitudinally inside the entirety of the tongue.

The protrusion, preferably the longitudinally outermost portion of the protrusion, may extend inwardly, such as being longitudinally inside, of the further locking groove in a direction along the second edge portion.

The second edge portion may comprise a, preferably vertical, side wall such that the protrusion is missing from a corner portion of the second panel, where the second and fourth edge portions meet.

The protrusion may be arranged vertically below the tongue, such as under a bottom surface of the tongue.

In some embodiments, however, the protrusion may protrude, preferably horizontally, outwards from the first edge portion and the groove may be arranged in the second edge portion.

The protrusion may extend longitudinally along the second edge portion. Generally herein, the protrusion may be integrally formed, i.e., formed in one piece, with the second edge portion.

The locking member may be resilient. Thereby, the locking member may bend, preferably outwards, during joining of the edge portions.

During joining, the first and second panels may be configured to assume a contacting joining position in which upper portions of the first and second edge portions cooperate with each other while the protrusion is located vertically above the groove. Preferably, the upper portion of the second edge portion cooperates with an uppermost portion of the first edge portion in the contacting joining position. Thereby, the upper portions, such as of short edge portions of the panels, may be substantially horizontally aligned during the joining before the protrusion enters the groove, which may increase the control and simplify the assembly of the panels. This may be particularly advantageous for panels that are difficult to displace along their perpendicularly arranged edge portions, such as long edge portions, when they are partially joined to each other. Such a displacement problem may arise in the partially joined state when the relative angle between the panels is low, such as below a coupling angle, which for example may be 20°, such as 10° or 8°, and/or when at least two pairs of contact surfaces of the perpendicularly arranged edge portions cooperate with each other. For contact surfaces having a high surface roughness, for example obtainable in SPC panels, large frictional forces may be obtained during the joining, even when only two pairs of contact surfaces cooperate with each other.

During joining, the first and second panels may be configured to assume a locking joining position in which upper portions of the first and second edge portions cooperate with each other while simultaneously, preferably inner portions of, the locking element and the locking member cooperate with each other. Preferably, the upper portion of the second edge portion cooperates with an uppermost portion of the first edge portion in the contacting joining position. Thereby, the first and second edge portions may be positioned horizontally as described above, while a displacement of the second panel along the perpendicularly arranged edge portions, such as long edge portions, may be counteracted, or even prevented.

An inner portion of the locking element may comprise a chamfer. Thereby, assembly of the panels may become more controlled and/or simplified. The chamfer may function as a guiding surface. Also, a bending of the locking member may be more controlled and directed.

The locking element may be configured to be arranged in a locking groove provided in the second edge portion. Alternatively, or additionally, the locking member may be configured to be arranged in a locking cavity provided in the first edge portion.

The protrusion may be arranged below an innermost portion of the locking groove. Thereby, the protrusion may become more displaceable during the joining. Preferably, the protrusion is arranged on a resilient locking member.

A depth of the locking groove may increase in a direction outwards from, preferably towards an outermost portion of, the second edge portion. Thereby, the locking groove may be reinforced, preferably while maintaining a degree of resilience of the locking member. Moreover, the panels may become stronger at their joints and hence may perform better in a Castor chair test. In addition, in some embodiments, a tendency of the upper strip to bend upwards may be counteracted, for example as compared to a locking groove having a constant depth corresponding to a maximal depth of said locking groove having an increasing depth.

The locking cavity may comprise a recess for accommodating the locking member, such as a portion thereof, during joining of the first and second edge portions. Thereby, the locking member may bend outwards from the second edge portion during the joining and into the recess. Also, a resilience of the lower strip may increase.

There may be a space between the locking member and a bottom portion of the locking cavity in a locked state of the first and second panels. Thereby, the vertical locking may be provided by at least two pairs of contact surfaces and the manufacturing of the locking device may be simplified.

In some embodiments, the locking member may cooperate with a bottom portion of the locking cavity in a locked state of the first and second panels. Thereby, an improved vertical locking with at least three pairs of contact surfaces may be provided. Also, a more stable locked state may be provided.

The lower strip may be resilient such that it is bendable downwards during joining of the first and second edge portions. For example, the locking element may bend downwards when the panels are arranged on an underlay element, such as a foam, provided on the subfloor or when the panels comprise a pre-attached underlay member.

A ratio between an extension of the lower strip and a panel thickness, such as a maximal panel thickness, of the first panel may be in the range of 1:2.5 to 1.8:1, preferably 1:1.8 to 1.8:1 or 1:1.4 to 1.4:1. Thereby, a more resilient lower strip may be provided, preferably while decreasing a risk of damaging, such as cracking, the lower strip.

The protrusion and groove may cooperate at upper cooperating surfaces of the protrusion and groove in a locked state of the first and second panels. Preferably, lower surfaces of the protrusion and groove are at least partially, such as completely, separated from each other.

An upper cooperating surface of the protrusion and/or the groove may form a locking angle of 0°-60° or 0°-45°, preferably 10°-50°, such as 10°-45° or 15°-35°, with respect to a second horizontal direction extending in parallel with a front and/or rear side of the panels. A lower locking angle may provide an increased vertical locking strength. Depending on the application, the upper cooperating surfaces may be essentially parallel or non-parallel with each other.

Upper portions of the first and second edge portions may comprise a shelf portion and a lap portion, respectively, configured to cooperate with each other at overlapping cooperating surfaces. Thereby, a better sealing of the locking device may be provided.

The shelf portion may comprise a shelf recess for housing at least a portion of the protrusion during joining of the first and second edge portions. At least in some embodiments, this may implement any of the contacting joining positions or locking joining positions disclosed herein.

A front side of the first and/or the second panel may comprise a bevel. Alternatively, or additionally, an upper portion of the second edge portion may comprise a lower bevel. The bevel and/or the lower bevel may protect an edge of the front side, for example by decreasing a risk of shearing of the edge, e.g., when the edge is sharp. In addition, the lower bevel may function as a guiding surface. In some embodiments, such as when a core of the panels comprises a thermoplastic material, such as PVC, and an inorganic filler, the bevel may implement a hiding function of imperfections of the locked panels. Indeed, an excessive resilience of the panels may in some scenarios, e.g., resulting from a large load of the panels, imply an impaired locking ability of the locking device. Also, the front sides of the panels may not be sufficiently vertically and/or horizontally aligned. The bevel may at least to a certain degree hide such deficiencies, e.g., by creating a repeated visual variation at the joints in the set.

The second edge portion may comprise a calibration groove. This may provide an easier assembly of panels having varying thicknesses.

The first and second edge portions may be short edge portions.

The horizontal locking may be further provided by upper portions, preferably including uppermost portions, of the first and second edge portions cooperating with each other.

A core of the first and second panel may comprise a thermoplastic material, preferably polyvinyl chloride, PVC, and an inorganic filler. In preferred embodiments, the core may comprise 20-40 wt % of a thermoplastic material, such as PVC, and 50-80 wt % of an inorganic filler. The inorganic filler may be a mineral material, for example calcium carbonate ($CaCO_3$), limestone, such as chalk, talc, fly ash, barium sulphate ($BaSO_4$), magnesium oxide (MgO), magnesium chloride, e.g., $MgCl_2$ and/or magnesium sulphate, e.g., $MgSO_4$, or a stone material, such as stone powder. Also other types of fillers are conceivable herein, such as an organic filler, e.g., a wood material, such as wood fibres or dust, a bamboo material or rice husks.

In some embodiments, the thermoplastic material may comprise PVC. In some embodiments, the thermoplastic material may comprise PVC, polyester, polyethylene, PE, polypropylene, PP, polystyrene, PS, thermoplastic polyurethane, TPU, or polyethylene terephthalate, PET, polyacrylate, methacrylate, polycarbonate, PC, polyvinyl butyral, PVB, polybutylene terephthalate, PBT, or a combination thereof. In some embodiments, the thermoplastic material may be a bioplastic material.

A core of the first and second panel may in some embodiments comprise a thermosetting resin, preferably comprising PU, an epoxy resin, or a melamine-formaldehyde resin. Preferably, the core comprises a filler, such as an inorganic and/or organic filler. Embodiments of the filler, such as their materials, degrees, etc., may be similar to the embodiments described herein in relation to filler in the thermoplastic material, whereby reference is made thereto.

A degree of plasticizer in the core may be less than 5 wt %, preferably less than 3 wt % or less than 1 wt %. The core and/or panel may have a modulus of elasticity, or Young's modulus E, of 1-10 GPa, such as 2-8 GPa, preferably determined in accordance with ISO 178:2010/A1:2013. For example, a rigid core may thereby be provided.

The core may be dense by not being foamed. In some embodiments, however, the core may be foamed. Preferably, the foaming may be incorporated in the thermoplastic material by means of a blowing agent or foaming agent. Generally herein, the core may for example be extruded.

The core may be formed of one or several layers. For example, the core may be included in an AB, ABA or ABC layer arrangement comprising two or three layers. Here, the same letter (A) and different letters (A, B or C) refer to the layers having substantially the same material composition and different material compositions, respectively. For example, at least two layers may be attached, such as laminated, to each other or at least two layers may be bonding layers bonded to each other by an adhesive. In some examples, at least two layers may be coextruded.

Other types of cores are also included herein. In some examples, the core may comprise, or may be, a wood-based core, such as a high-density fibreboard, HDF board, a medium-density fibreboard, MDF board, or a plywood board. In some examples, the core may comprise a polyurethane, PUR, and/or a thermosetting resin and, optionally, MgO.

Generally herein, one, several, or even all, of the following dimensions are preferred, yet non-limiting. A panel thickness, such as a maximal panel thickness, may be 3.5-6.0 mm, preferably 4.0-5.5 mm. A, preferably maximal, thickness of the lower strip inwardly of the locking element may be 0.8-3.0 mm. A horizontal extension of the protrusion may be 0.08-1.0 mm. A, preferably maximal, depth of the locking groove may be 1.5-4.0 mm. A, preferably maximal, width of the locking element and/or the locking member may be 1.0-3.0 mm.

Generally, all terms used herein, such as in the claims and in the items in the embodiment section below, are to be interpreted according to their ordinary meaning in the technical field, unless explicitly defined otherwise. All references to "a/an/the [element, device, component, means, step, etc.]" are to be interpreted openly as referring to at least one instance of said element, device, component, means, step, etc., unless explicitly stated otherwise. Reference to one or a plurality of "at least one element," etc., may shortly be referred to as "the element(s)."

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Figure 1A:
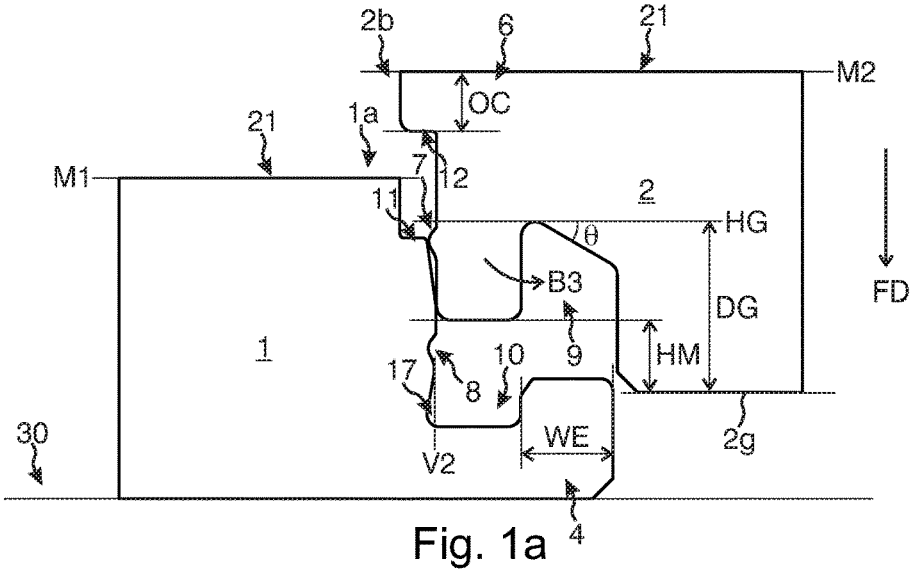
FIGS. 1*a*-1*c* illustrate in a cross-sectional side view (FIG. 1*b*) and in an enlarged side view (FIG. 1*c*) an embodiment of a first and a second panel in a locked state and in a cross-sectional side view an embodiment of those panels during joining of their edge portions (FIG. 1*a*).
Figure 1B:
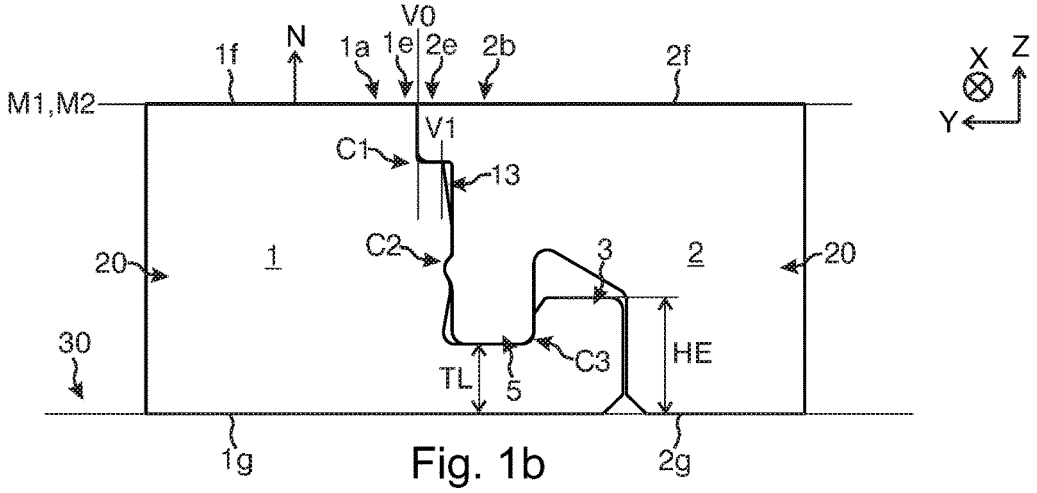

In the following, various embodiments of a set of building panels, often abbreviated herein as "panels," such as floor panels, will be described with reference to, e.g., FIGS. 1*a*-1*d*, 2*a*-2*c*, 3*a*-3*c*, 4*a*-4*c*, 5*a*-5*c*, 6*a*-6*c*, 7*a*-7*d*, 8*a*-8*f* and 9*a*-9*d*. The set comprises a first 1 and a second 2 panel comprising a first edge portion 1*a* and an adjacent second edge portion 2*b*, respectively, and a locking device for vertical and horizontal locking, which preferably is a mechanical locking device. Preferably, the panels disclosed herein are essentially identical. Moreover, the panels may be floor panels for installing a floor covering on a subfloor 30, but wall panels for installing a wall cladding on a substructure are equally conceivable. The panels 1, 2 each comprises a front side 1*f*, 2*f* and a rear side 1g, 2g, preferably extending along a first X and a perpendicular second Y horizontal direction. For example, a longitudinal extension of the first 1*a* and second 2*b* edge portions may extend along the first horizontal direction X. A normal N of a main plane M1, M2 extending along the front side 1*f*, 2*f* and/or the rear side 1g, 2g defines a vertical direction Z. The vertical direction Z may be parallel with a thickness direction of the panels 1, 2. Moreover, widths WE, WM, WR, WP, WG specified herein may extend along the second horizontal direction Y.

The first 1*a* and second 2*b* edge portions are configured to be joined to each other by a relative essentially vertical displacement of the first 1 and second 2 panels against each other, preferably comprising a folding displacement FD. Examples of such joining are shown in, e.g., FIGS. 1*a*, 1*d*, 2*a*, 4*a*, 7*a*, 8*a*-8*b*, 8*d*, 8*f* and 9*c*. A manual pressure, such as from a thumb, of an installer of the set of panels, may be sufficient for assembling the panels 1, 2. In particular, no tools, such as a rubber mallet, may be needed, although use of tools is not excluded.

The panels 1, 2 in the set may be rectangular. Preferably, the first 1*a* and second 2*b* edge portions are short edge portions. It is clear that the panels 1, 2 may further comprise opposing short edge portions 1*b*, 2*a* as shown in, e.g., FIGS. 6*a*-6*b*, 7*a* and 8*a*-8*b*. The panels 1, 2 may further comprise perpendicularly arranged edge portions in the form of third 1*c*, 2*c* and fourth 1*d*, 2*d* opposing edge portions, which preferably are long edge portions, see, e.g., FIGS. 6*a*-6*c*, 7*a*-7*b* and 8*a*-8*b*. For example, a longitudinal extension of the third and fourth edge portions may extend along the second horizontal direction Y.

The set may comprise additional panels, such as a plurality of panels. For example, and as illustrated in, e.g., FIGS. 7*a*-7*b*, the set may comprise a third panel 1' to which the panels 1, 2 may be assembled, such as along a third edge portion 1*c'*.

Figure 3A:
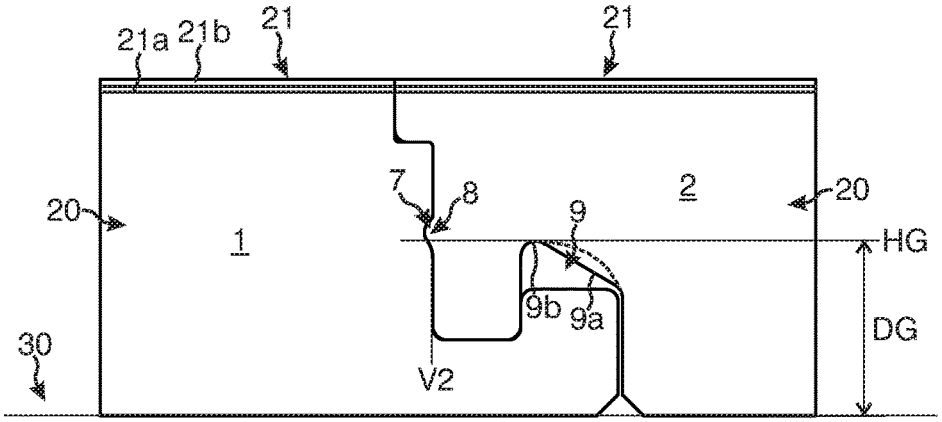
FIGS. 3*a*-3*c* illustrate in cross-sectional side views embodiments of locked edge portions of a first and a second panel.
Figure 3B:
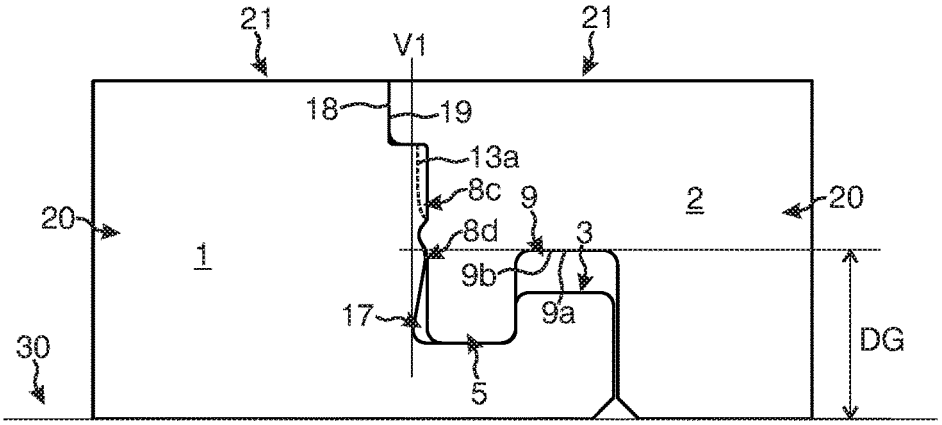
Figure 3C:
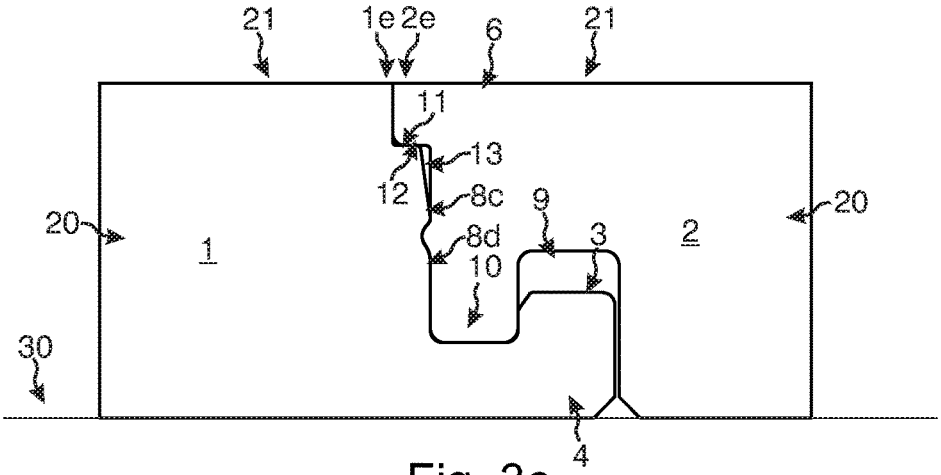
Figure 4A:
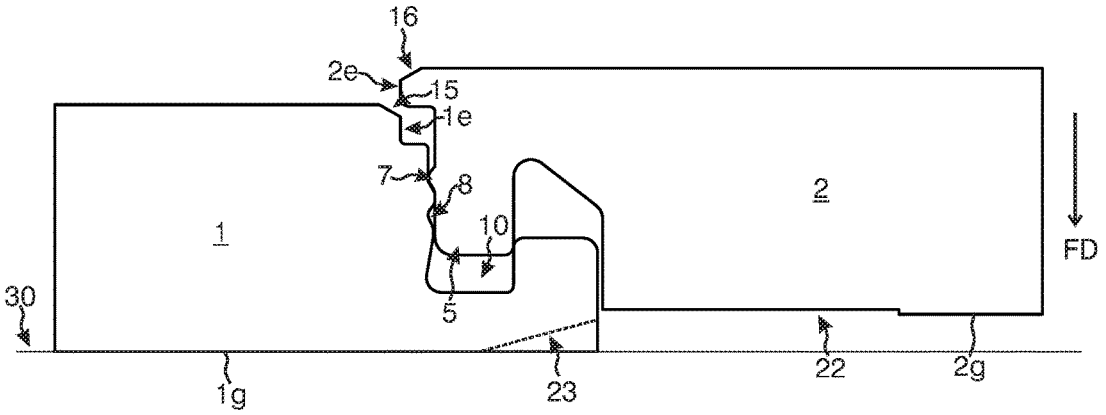
FIGS. 4*a*-4*b* illustrate in cross-sectional side views an embodiment of a joining of edge portions of a first and a second panel (FIG. 4*a*) and those panels in a locked state (FIG. 4*b*).
Figure 6C:
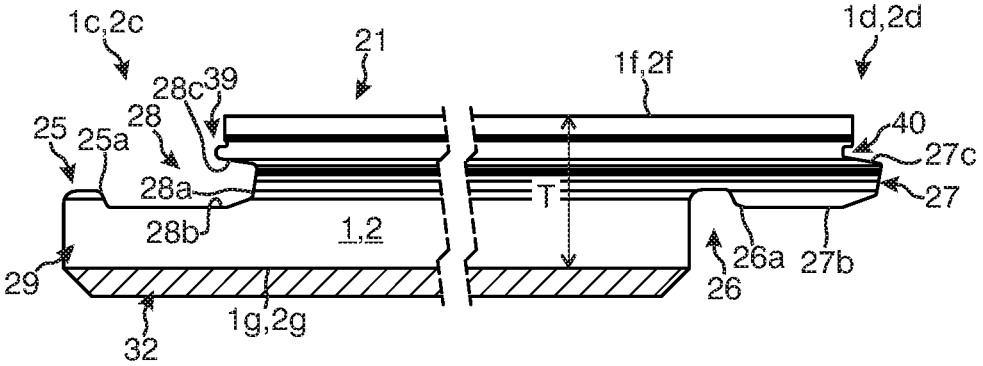
Figure 7A:
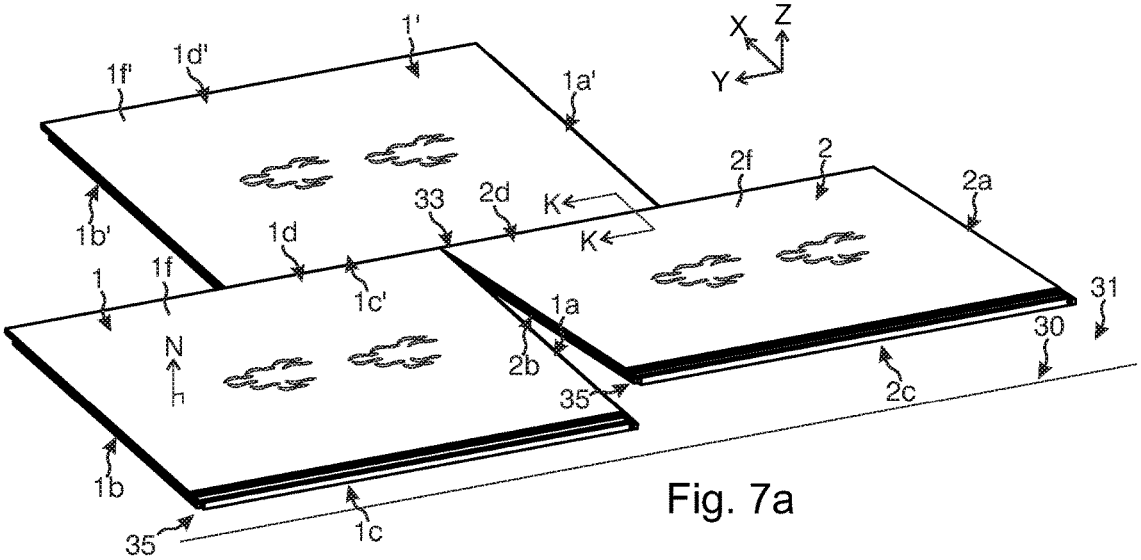
FIGS. 7*a*-7*b* illustrate in a perspective view (FIG. 7*a*) and a cross-sectional front view K-K (FIG. 7*b*) embodiments of panels that are being assembled to each other.
Figure 7B:
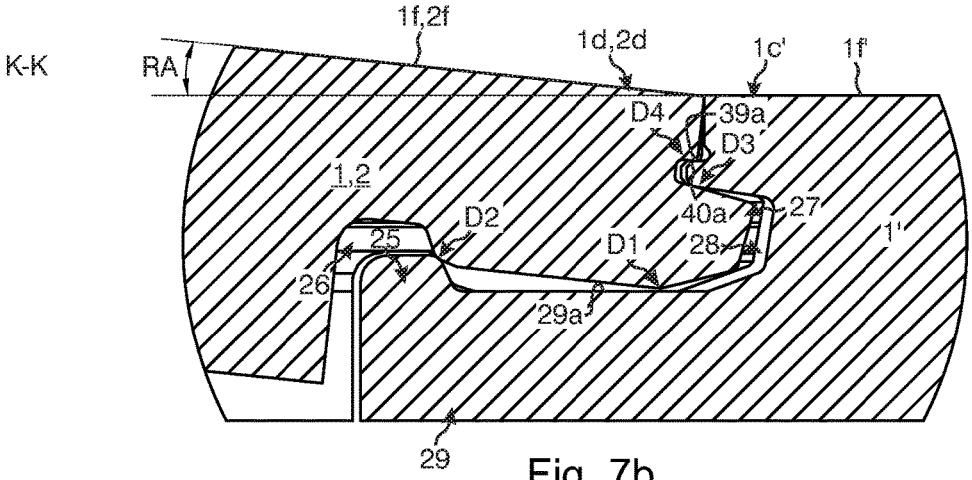

The fourth edge portions 1*d*, 2*d* may comprise a further locking device configured to be joined to a perpendicularly arranged edge portion 1*c*', preferably a long edge portion, of the third panel 1' arranged on the subfloor 30 by angling, for example as shown in FIG. 7*a*-7*b* or as described on page 6, line 26 to page 7, line 17 together with FIGS. 3 and 4*a* in WO 2021/058137, which parts are hereby explicitly incorporated by reference. The third edge portion 1*c*' may be horizontally locked to the adjacent fourth edge portion 1*d* and/or 2*d* by means of a further locking element 25 provided on a further strip 29 cooperating with a further locking groove 26 and vertically locked thereto by means of a cooperating tongue 27 and tongue groove 28, cf. FIGS. 6*c* and 7*b*. The further strip 29 may protrude horizontally from a lower portion of the third edge portion 1*c*' and the further locking groove 26 may be provided in the fourth edge portion 1*d*, 2*d*, preferably being open downwards. Moreover, the tongue 27 and tongue groove 28 may be provided in the fourth edge portion 1*d*, 2*d* and in the third edge portion 1*c*', respectively. Optionally, the further locking device may further comprise a supplementary tongue 39 and supplementary tongue groove 40 in the third 1*c*' and fourth 1*d*, 2*d* edge portion, respectively, for vertical locking, cf. FIGS. 6*c* and 7*a*-7*b*. It is clear that the third edge portion 1*c*, 2*c* of the panel 1, 2 may comprise a further locking device similar to that in the third edge portion 1*c'*.

It is emphasized that embodiments in which the opposing edge portions 1*a*, 1*b*, 2*a*, 2*b* are long edge portions and the opposing edge portions 1*c*, 2*c*, 1*d*, 2*d* are short edge portions are included herein mutatis mutandis. In yet some embodiments, the panels may be square.

In non-limiting examples, a panel thickness T, such as a maximal panel thickness, of any panel 1, 2, 1' herein may be 3.5-6.0 mm, preferably 4.0-5.5 mm. Preferably, the panel thickness T is determined without the inclusion of an underlay element 31 or an underlay member 32.

The panels 1, 2, 1' herein may be building panels, such as floor panels or wall panels, and may be configured to be arranged on, or connected to, a substructure, such as a subfloor 30. In preferred embodiments, the panels are floor panels configured to be arranged on and along a subfloor 30, preferably in a floating manner. The horizontal directions X, Y may extend in parallel with the substructure, such as the subfloor 30, and the vertical direction Z may extend perpendicularly thereto, see, e.g., FIGS. 6*a*, 7*a* and 8*a*. Consequently, in the case of wall panels, the horizontal directions X, Y may extend along a visible wall surface, one of which (say X) typically being provided perpendicularly to a subfloor 30 in an environment in which the wall panels are assembled, and the vertical direction Z, together with the other horizontal direction (say Y), extending along the subfloor.

A core 20 of the first 1 and second 2 panels, preferably of all panels in the set, may comprise a thermoplastic material, such as PVC, polyester, PE, PP, PS, TPU, PET, polyacrylate, methacrylate, PC, PVB, or PBT, or a combination thereof, and a filler, preferably an inorganic filler. In preferred embodiments, the core may comprise 20-40 wt % of a thermoplastic material, such as PVC, and 50-80 wt % of an inorganic filler, such as $CaCO_3$, limestone, talc, fly ash, $BaSO_4$, MgO, or a stone material. A degree of plasticizer in the core 20 may be less than 5 wt %, preferably less than 3 wt % or less than 1 wt %, and may be in the range of 0.1-5 wt %, 0.5-5 wt %, or 0.5-3 wt %. Generally herein, the core 20 may be dense or, alternatively, foamed. In any embodiment herein, the core 20 and/or the panel 1, 2 per se, may have an E module, of 2-12 GPa, such as 4-9 GPa or 3-7 GPa.

Any panel 1, 2 herein may comprise a top layer 21, such as a print layer 21*a* and/or a wear layer 21*b*, applied, such as bonded, to the core 20, see, e.g., FIG. 3*a*. In some embodiments, the top layer 21 is formed by digitally printing a print P directly on the core 20 or a print-receiving layer arranged thereon, and optionally by applying a wear layer 21*b* thereon, cf. FIG. 2*c*. The print layer and/or wear layer in any of the examples above may be provided as a thermoplastic-based foil or film, for example, comprising PVC. For example, a thickness of the print layer and wear layer may be 0.02-0.20 mm and 0.05-1.0 mm, respectively. Alternatively, or additionally, the wear layer may be a transparent coating layer, such as a UV curable coating layer, a lacquer or a hotmelt coating layer. Optionally, the top layer 21 may be embossed.

By means of the locking device, the panels 1, 2 may be assembled to each other to obtain a locked state in which the first edge portion 1*a* of the first panel 1 and the second edge portion 2*b* of the second panel 2 are horizontally and vertically locked to each other.

The locking device comprises a locking element 3 extending upwards from a lower strip 4 provided in the first edge portion 1*a*, and a locking member 5 extending downwards from an upper strip 6 provided in the second edge portion 2*b*. The lower 4 and upper 6 strip may protrude horizontally outwards from a lower and upper portion of the first 1*a* and second 2*b* edge portion, respectively. In non-limiting examples, a, preferably maximal, thickness TL of the lower strip 4 inwardly of the locking element 3 may be 0.8-3.0 mm. The locking element 3 is configured to be arranged in a locking groove 9 provided in the second edge portion 2*b*, and the locking member 5 is configured to be arranged in a locking cavity 10 provided in the first edge portion 1*a*. The locking element 3, such as an inner portion 3*a* thereof, may extend vertically to a height HE from the rear side 1*g*. Moreover, the locking member 5, such as an inner portion 5*a* thereof, may extend vertically to a height HM from the rear side 2*g*. HE may exceed HM such that a horizontal locking may be provided. For example, HE>1.4·HM, such as HE>1.6·HM or HE>1.8·HM. A larger HE and/or a lower HM allows for the locking member 5 to cooperate with the locking element 3 in an earlier stage of the joining. In non-limiting examples, the height HE may be 1.5-4.0 mm and/or the height HM may be 1.0-3.0 mm.

Alternatively, or additionally, the locking member 5 may extend from the front side 2*f* by more than half, such as exceeding 0.6 or even exceeding 0.7, a panel thickness T.

The thickness TL may in some embodiments be less than 2 mm, such as 0.8-2 mm. Thereby, the lower strip 4 may become more resilient.

It is understood that the locking element 3, locking member 5, locking groove 9, and locking cavity 10 may extend along the first 1*a* and second 2*b* edge portions, e.g., along the first horizontal direction X, such as along substantially their entirety.

An upper portion 1*e* of the first edge portion 1*a* may be configured to cooperate, such as engage, with an upper portion 2*e* of the second edge portion 2*b* in the locked state of the panels 1, 2. For example, the upper portions 1*e*, 2*e* may comprise joining surfaces 18, 19 extending substantially vertically (see, e.g., FIGS. 1*a*-1*d*, 2*a*-2*c*, 3*a*-3*c*, 4*a*-4*c*, 5*a*, 5*c*, 6*b*, 8*c*-8*f* and 9*a*-9*d*) or extending at an angle φ' with respect to the vertical direction Z (see, e.g., FIG. 5*b*). A vertical plane V0 may extend between the upper portions 1*e*, 2*e* in the locked state, such as along the joining surfaces 18, 19 and/or along their uppermost portions 1*h*, 2*h*. The upper portions 1*e*, 2*e* may cooperate at least along these uppermost portions 1*h*, 2*h*, such as along essentially the entire joining surfaces 18, 19. In non-limiting examples, the upper portion 1*e*, 2*e* and/or the joining surface 18, 19 may be located in the upper half part, preferably in the upper third part, more preferably in the upper quarter part, of the respective panel 1, 2.

The upper portion 1*e* may in some embodiments comprise a shelf portion 11 and the upper portion 2*e* may comprise a lap portion 12, see, e.g., FIGS. 1*a*-1*d*, 2*a*-2*c*, 3*a*-3*c*, 4*a*-4*c*, 5*a*-5*b*, 6*b*, 8*c*-8*f* and 9*a*-9*d*. Overlapping cooperating surfaces 11*a*, 12*a* of the shelf portion 11 and the lap portion 12 may be configured to cooperate, such as engage, with each other. The overlapping cooperating surface 12*a* may extend, preferably essentially horizontally, at a distance OC from the front side 2*f*. In non-limiting examples, OC may be 0.8-2.0 mm. For example, the overlapping cooperating surfaces 11*a*, 12*a* may extend horizontally about 0.1-1.0 mm. The joining surface 19 may extend above the shelf portion 11, such as above the cooperating surface 11*a*, and the joining surface 18 may extend along the lap portion 12, such as above the cooperating surface 12*a*.

Figure 5A:
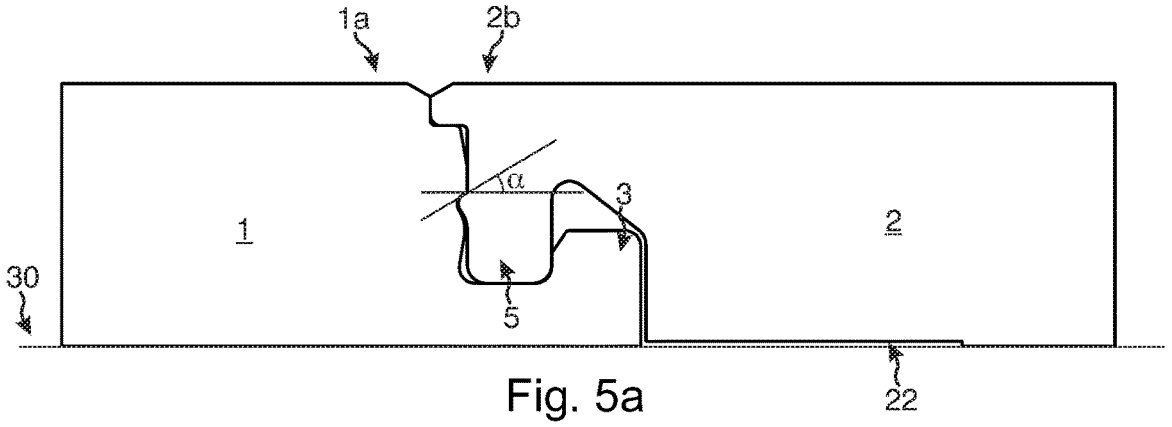
FIGS. 5*a*-5*c* illustrate in cross-sectional side views embodiments of locked edge portions of a first and a second panel.
Figure 5B:
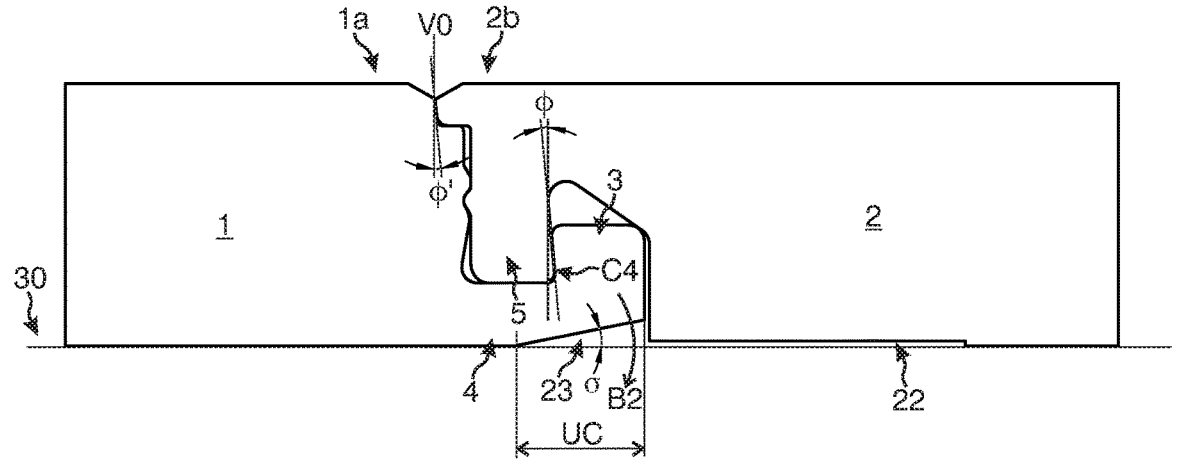
Figure 5C:
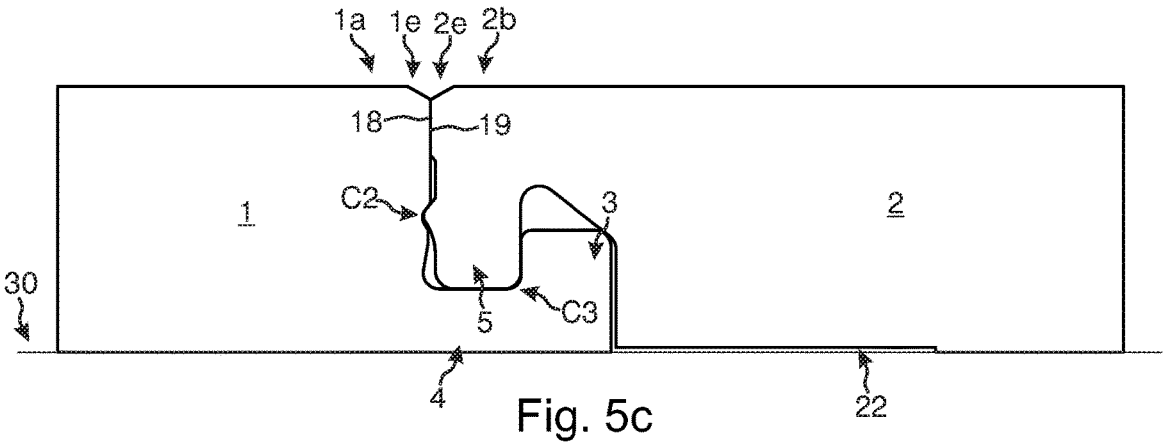

It is emphasized that overlapping upper portions 1*e*, 2*e* are optional and that the upper portions 1*e*, 2*e*, such as the joining surfaces 18, 19, in some embodiments may extend essentially vertically, see, e.g., FIG. 5*c*.

The locking element 3 and the locking member 5 are configured to cooperate, such as engage, for horizontal locking of the first 1*a* and second 2*b* edge portions. Preferably, the inner portions 3*a*, 5*a* cooperate, such as engage, with each other in the locked state. Optionally, the horizontal locking may be further provided by the upper portions 1*e*, 2*e* cooperating, such as engaging, with each other.

The locking device further comprises a protrusion 7 and a groove 8 arranged in the first 1*a* and second 2*b* edge portions. The protrusion 7 may be integrally formed with the second edge portion 2*b*, such as with the core 20. Moreover, the protrusion 7 may protrude, preferably horizontally, outwards from the second edge portion 2*b* and the groove 8 may be arranged in the first edge portion 1*a*. For example, the protrusion may be substantially shaped as a bulb, but other shapes are equally conceivable, such as a substantially triangular, rectangular, or polygonal shape. In non-limiting examples, a width WP of the protrusion 7 herein may be 0.08-1.0 mm. Preferably, WP is determined from a vertical plane V3 extending along an outer portion 5*c* of the locking member 5, such as along a lowermost outer portion thereof, cf. FIG. 1*c*. The protrusion 7 and a groove 8 may extend along the first 1*a* and second 2*b* edge portions, e.g., along the first horizontal direction X, such as along substantially their entirety.

The protrusion 7 and the groove 8 are configured to cooperate, such as engage, for vertical locking of the first 1*a* and second 2*b* edge portions. An upper cooperating surface 7*a* of the protrusion 7 may cooperate with an upper cooperating surface 8*a* of the groove 8 in the locked state. The upper cooperating surface(s) 7*a* and/or 8*a* may be at least partially planar. The upper cooperating surface 7*a* and/or 8*a*, such as the planar portion, may form a locking angle α of 0°-60° or 0°-45°, preferably 10°-50°, such as 10°-45° or 15°-35°, with respect to the second horizontal direction Y. For example, in FIGS. 1*c* and 5*a* the locking angle α is about 50° and 30°, respectively.

The protrusion 7, preferably a horizontally outermost portion thereof, may be provided horizontally inside of the vertical plane V0 with respect to the second panel 2.

In a first example, the upper cooperating surfaces 7*a*, 8*a*, such as the respective locking angles α, are essentially parallel with each other. In a second example, the upper cooperating surfaces 7*a*, 8*a* are non-parallel with each other, preferably such that the locking angle α of the upper cooperating surface 7*a* is lower than the locking angle α of the upper cooperating surface 8*a*. Thereby, the vertical locking function may be provided in a horizontally deeper part of the groove 8. Alternatively, however, the locking angle α of the upper cooperating surface 8*a* may be lower than the locking angle α of the upper cooperating surface 7*a*. In either case of the second example, a difference between the non-parallel upper cooperating surfaces 7*a*, 8*a*, such as between the respective locking angle α, may be 1°-30°, preferably 2°-15°, more preferably 3°-7°.

The groove 8 may be arranged between an upper 8*c* and a lower 8*d* lip provided above and below the groove 8, respectively. The upper lip 8*c* and the lower lip 8*d* may extend horizontally outwards from a vertical plane V1 extending along an innermost portion of the first edge portion 1*a* provided at or below the shelf portion 11, cf. FIGS. 1*b*, 2*a* and 3*b*. For example, the vertical plane V1 may extend along an innermost portion 10*a* of the locking cavity 10.

Preferably, a lower surface 7*b* of the protrusion 7 is at least partially, such as entirely, separated from a lower surface 8*b* of the groove 8 in the locked state. Optionally, the locking device may further comprise the overlapping cooperating surfaces 11*a*, 12*a* for vertical locking of the first 1*a* and second 2*b* edge portions.

In some embodiments herein, e.g., in any of FIGS. 1*a*-1*d*, 2*a*-2*c*, 3*a*-3*c*, 4*a*-4*c*, 5*a*-5*c*, 6*a*-6*c*, 7*a*-7*d*, 8*a*-8*f* and 9*a*-9*d*, the locking member 5 may be resilient such that it is bendable, preferably outwards (see arrow B1 in FIGS. 1*d* and 2*a*) with respect to the second panel 2. The locking member 5 may bend outwards during cooperation with the locking element 3. Alternatively, or additionally, the lower strip 4 may be resilient such that it is bendable downwards during joining of the first 1*a* and second 2*b* edge portions (see arrow B2).

At least a part of a resilience of the locking member 5 may in some embodiments be accomplished by means of a residual groove portion 9*c* of the locking groove 9 that is formed in the locked state. A top portion 3*b* of the locking element 3 and an upper wall 9*a* of the locking groove 9 may be separated from each other and may define the residual groove portion 9*c*.

In some embodiments, as shown in, e.g., FIGS. 1*a*-1*d*, 2*a*-2*c*, 3*a*, 4*a*-4*c*, 5*a*-5*c*, 6*b*, 7*c*-7*d*, 8*e*-8*f* and 9*a*-9*d*, a depth DG of the locking groove 9 increases in a direction outwards from, preferably towards an outermost portion of, the second edge portion 2*b*, preferably along the second horizontal direction Y. The upper wall 9*a* of the locking groove 9 may be inclined by an angle θ with respect to the second horizontal direction Y. For example, the angle θ may be 20°-60°. In a first example, at least a centre portion of the upper wall 9*a*, such as essentially its entirety, is planar. In a second example (see, e.g., the broken line in FIG. 3*a*), the upper wall 9*a* is curved.

In non-limiting examples, the depth DG of the locking groove 9 may be 1.5-4.0 mm. DG may be a maximal depth of the locking groove, such as from the rear side 2*g* to an innermost portion 9*b* of the locking groove. The depth DG and the innermost portion 9*b* may be determined along the vertical direction Z. A horizontal plane HG may extend through the innermost portion 9*b*.

As shown in, e.g., FIGS. 1*a*-1*d*, 2*a*-2*c*, 4*a*-4*c*, 5*a*-5*c*, 6*b*, 7*a*-7*d*, 8*e*-8*f* and 9*a*-9*d*, the protrusion 7 may be arranged vertically below the innermost portion 9*b*. In some embodiments, however, and as shown in, e.g., FIGS. 3*a*-3*c*, the protrusion 7 may be arranged at and/or above the innermost portion 9*b*, whereby the protrusion may become less displaceable during the joining.

The inner portion 3*a* and the top portion 3*b* of the locking element 3 may be arranged at an angle with respect to each other, such as at essentially a right angle (see, e.g., FIG. 1*a*-1*c*) or at an acute angle (see FIG. 5*b*). For example, the inner portions 3*a*, 5*a* may be planar. Hence, the inner portions 3*a*, 5*a* of the locking element 3 and the locking member 5 may extend substantially in parallel or at an angle 4 with respect to the vertical direction Z. Inclined inner portions 3*a*, 5*a* may provide vertical locking of the edge portions 1*a*, 2*b*. For example, ϕ may be 1°-10°, such as 1°-5°. The upper portions 1*e*, 2*e* may also be inclined to the vertical by an angle ϕ', preferably by the same angle ϕ. Thereby, the inclined portions may be formed by a single tool.

Optionally, there may be a chamfer 14 arranged in the inner portion 3*a*. The chamfer 14 may be planar and may form an angle δ against the second horizontal direction Y, see, e.g., FIG. 1*c*. For example, the angle δ may be between 30° and 50°, preferably 35°-45°. In some embodiments, and as shown in FIG. 2*b*-2*c*, 3*a*-3*b*, 4*a*-4*b*, 5*b*-5*c*, 6*b*, 8*d* and 9*c*-9*d* the chamfer 14 may be curved, for example having a radius of 0.1-0.8 mm at a vertex portion where the inner and top portions 3*a*, 3*b* meet.

As shown in, e.g., FIGS. 1*a*-1*d*, 2*a*-2*c*, 3*b*, 4*a*-4*c*, 5*a*-5*c*, 6*b* and 9*c*-9*d*, the locking cavity 10 may comprise a recess 17 for accommodating at least a portion of the locking member 5 during joining of the first 1*a* and second 2*b* edge portions. FIG. 1*d* illustrates such a joining where the locking member 5 bends outwards and into the recess 17. Optionally, also the lower strip 4 bends during the joining. The recess 17 may be provided at a horizontally innermost portion of the lower strip 4, for example extending inwardly from a vertical plane V2 provided along a horizontally outermost portion of the lower lip 8*d*. For example, a width WR of the recess may be 0.1-1 mm, cf. FIG. 1*c*.

A width WG of a bottom portion 10*b* of the locking cavity 10, optionally including the recess 17, may essentially correspond to or may exceed a width WM of the locking member 5. The width WM (WG) may be a maximal width of the locking member 5 (bottom portion 10*b*).

In non-limiting examples, a preferably maximal, width WE, WM of the locking element 3 and/or the locking member 5 may be 1.0-4.0 mm, such as 1.5-3.0 mm.

A ratio between an extension ES of the lower strip 4 and the panel thickness T of the first panel 1 may be in the range of 1:2.5 to 1.8:1, preferably 1:1.8 to 1.8:1 or 1:1.4 to 1.4:1. The extension ES may be an extension from the innermost portion 10*a* of the locking cavity 10 to an outermost portion 4*a* of the lower strip 4, cf. FIG. 2*a*. For example, the extension ES may be an extension from the vertical plane V1. Optionally, the locking cavity 10 may comprise the recess 17.

Figure 1C:
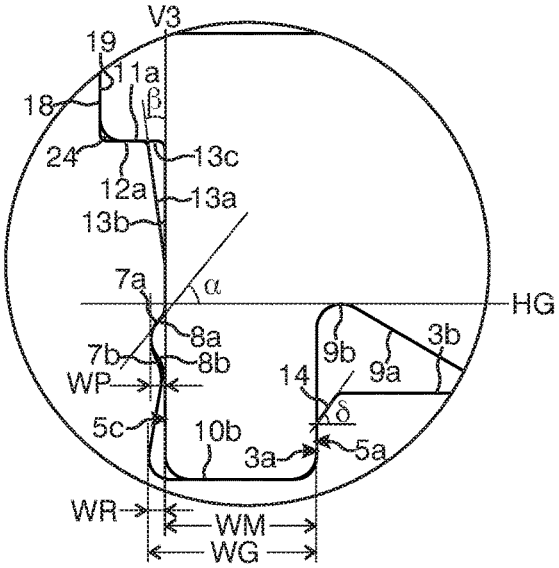
Figure 1D:
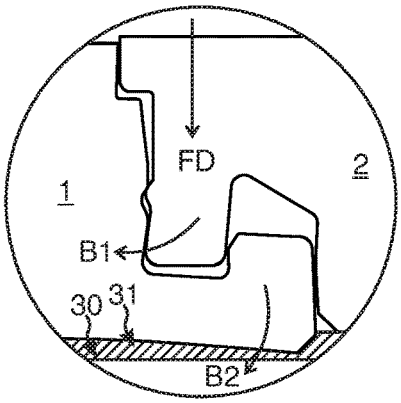
FIG. 1*d* illustrates in a cross-sectional side view an embodiment of a joining of edge portions of panels.
Figure 2A:
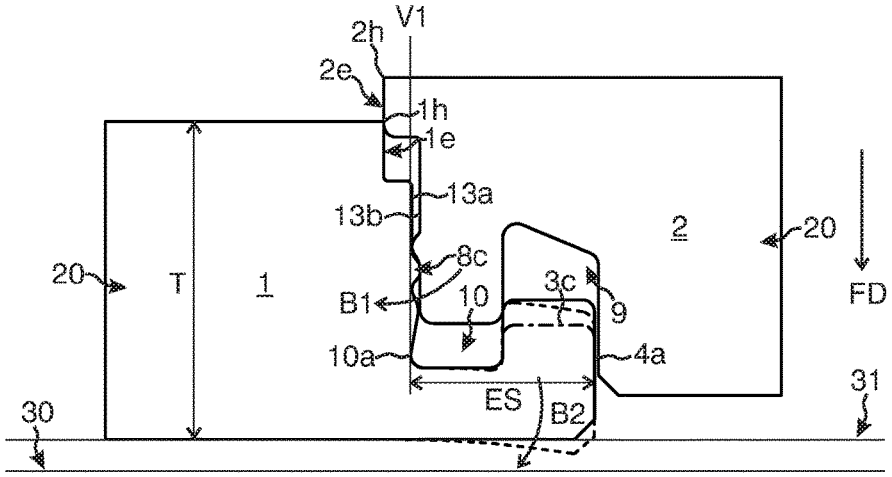
FIGS. 2*a*-2*b* illustrate in cross-sectional side views an embodiment of a joining of edge portions of a first and a second panel (FIG. 2*a*) and those panels in a locked state (FIG. 2*b*).
Figure 2B:
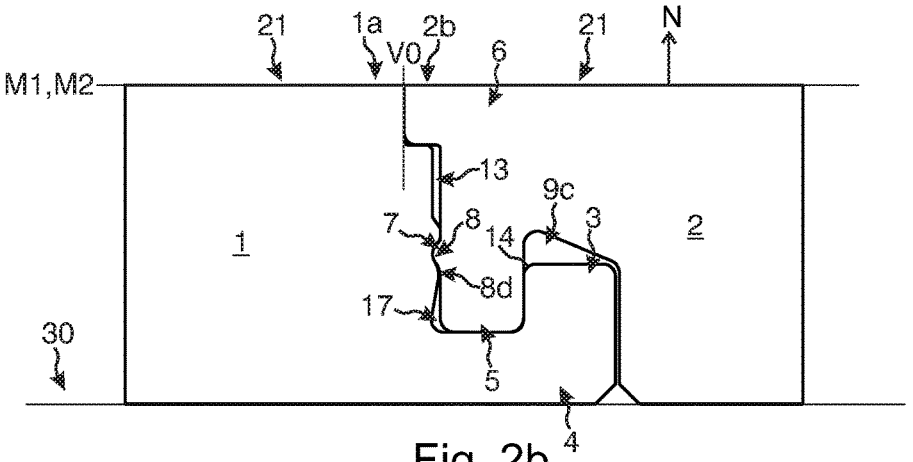
Figure 2C:
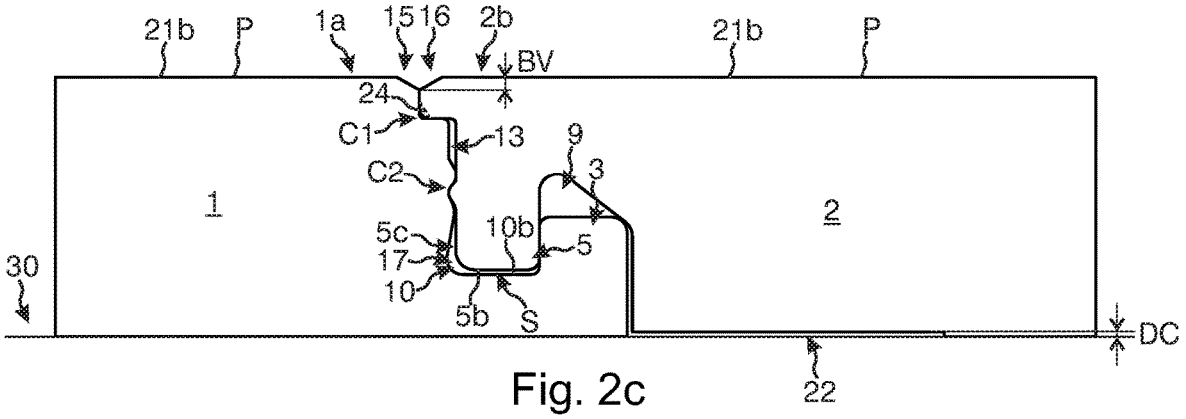
FIG. 2*c* illustrates in a cross-sectional side view an embodiment of locked edge portions of a first and a second panel.
Figure 8A:
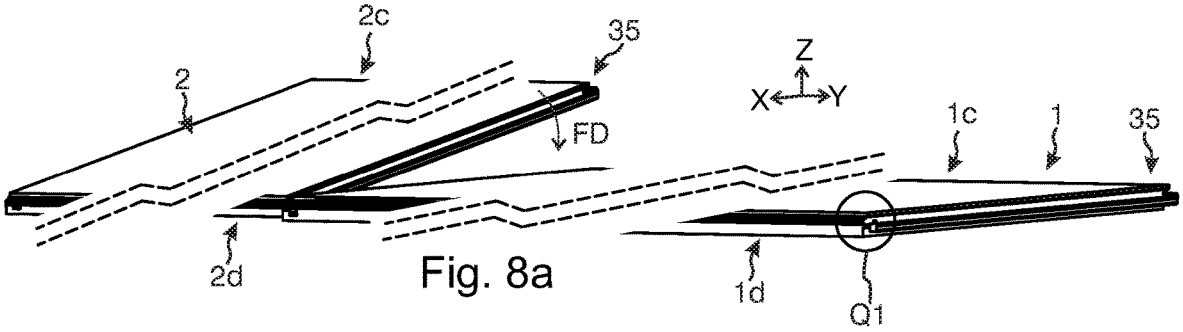
FIGS. 8*a*-8*b* illustrate in a perspective view (FIG. 8*a*) and a side view (FIG. 8*b*) an embodiment of panels that are being assembled to each other.
Figure 8B:
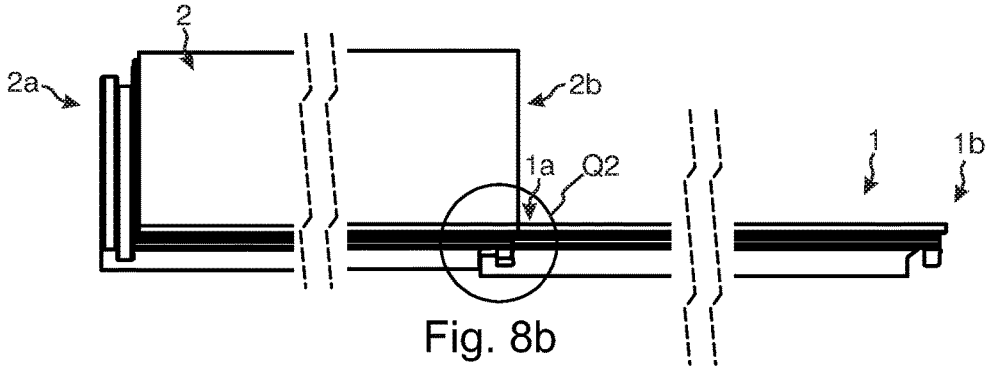
Figure 8C:
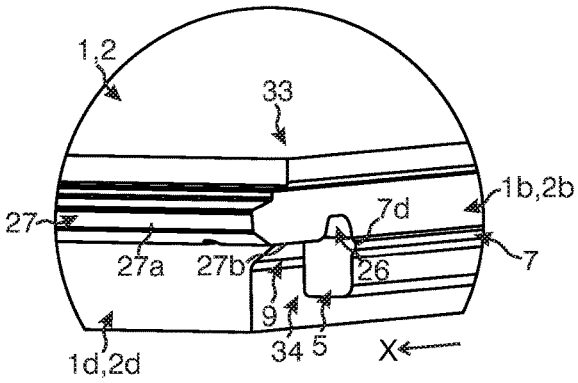
FIGS. 8*c*-8*f* illustrate enlarged views Q1, Q2 of a corner portion of the panels in FIGS. 8*a*-8*b* according to two different embodiments (FIGS. 8*c*-8*d* and FIGS. 8*e*-8*f*, respectively).
Figure 8D:
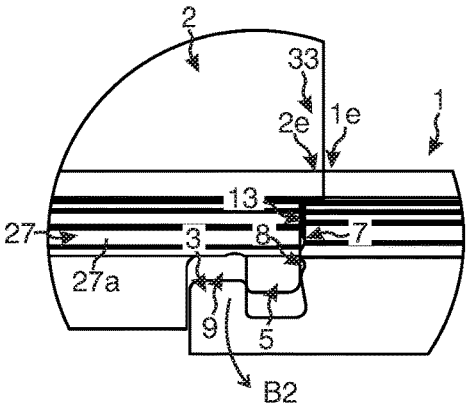

In some embodiments, the first 1 and second 2 panels are configured to assume a contacting joining position during the joining in which the upper portions 1*e*, 2*e* cooperate, such as engage, with each other while the protrusion 7 is located, preferably entirely, vertically above the groove 8, see, e.g., FIGS. 1*d*, 2*a* and 8*d*. For example, the joining surfaces 18, 19 may cooperate, such as engage, with each other. Preferably, the upper portion 2*e* cooperates with an uppermost portion 1*h* of the first edge portion 1*b* in the contacting joining position. The uppermost portion 1*h* may be disposed at a region where the joining surface 19 and the front side 1*f* meet. For example, the protrusion 7 may be located vertically above the upper lip 8*c*. In some embodiments, the locking member 5 may be separated from the locking element 3 in the contacting joining position. This is illustrated in FIG. 2*a* by a locking element 3 extending vertically only to the dash dotted line 3*c*. Optionally, and as illustrated in said figures, the locking element 3 and the locking member 5 may simultaneously further cooperate, such as engage, with each other for assuming a locking joining position of the first 1 and second 2 panels. Preferably, the inner portions 3*a*, 5*a* cooperate with each other. Thereby, a displacement of the second panel 2 along the third 2*c* or fourth 2*d* edge portions, e.g., along the second horizontal direction Y, may be counteracted, or even prevented.

Preferably, HE exceeds HM+OC for implementing the contacting and/or the locking joining position. If the panels 1, 2 comprise a bevel 15, 16 (see below), the vertical extension of the bevel BV at the upper portions 1*e*, 2*e* may be disregarded so that HE preferably exceeds HM+OC-BV, cf., FIG. 2*c*.

The shelf portion 11 may in some embodiments comprise a shelf recess 13 for housing at least a portion of the protrusion 7 during the joining of the first 1*a* and second 2*b* edge portions, see. e.g., FIGS. 1*a*-1*d*, 2*a*-2*c*, 3*b* (see broken line), 3*c*, 4*a*-4*c*, 5*a*-5*b*, 6*b* and 8*d*.

The shelf recess 13 may be defined by a recess wall 13*a* disposed in the first edge portion 1*a*. The recess wall 13*a* may be formed in or above the upper lip 8*c*. The recess wall 13*a* may assume various shapes. As shown in FIG. 3*b* by the broken line, the recess wall 13*a* may be curved. In some embodiments, the recess wall 13*a* may be essentially planar, and may form an angle R with respect to the vertical direction Z, cf. FIG. 1*c*. For example, β may be 5°-45°, such as 5°-25°. An inclined recess wall 13*a* may gradually displace the second edge portion 2*b* horizontally outwards with respect to the first edge portion 1*a* during joining. The recess wall 13*a* may function as a guiding surface. In FIGS. 2*a*-2*c*, 4*a*-4*b*, 5*b*, 6*b* and 8*d*, the recess wall 13*a* is provided essentially in parallel with the vertical direction Z (hence β=0°). Thereby, the upper portions 1*e*, 2*e* may be arranged essentially at a constant distance from each other, preferably cooperating with each other, during an initial part of the joining until the upper lip 8*c* starts to exert pressure on the protrusion 7, and optionally pushes it outwards.

The shelf recess 13 may at least in some embodiments be needed for implementing said contacting joining position and/or locking joining position. Indeed, by means of the shelf recess 13 the upper portions 1*e*, 2*e* may come closer to each other during an initial part of the joining.

The shelf recess 13 may extend below the overlapping cooperating surface 11*a*. In the locked state, the shelf recess 13 may be further defined by an upper wall segment 13*c* provided inwardly of the overlapping cooperating surface 12*a* and/or by an opposing recess wall 13*b* disposed in the second edge portion 2*b*, preferably below the lap portion 12. For example, the opposing recess wall 13*b* may be provided essentially in parallel with the vertical direction Z.

Figure 9A:
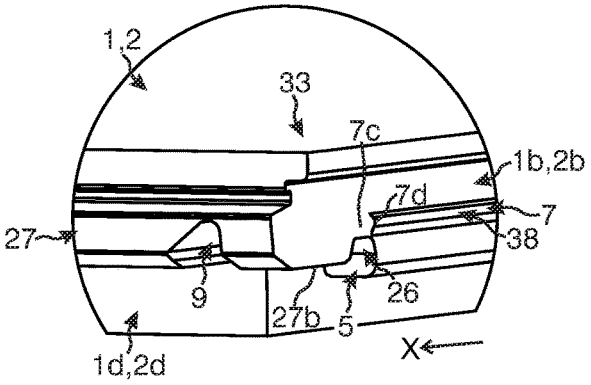
FIGS. 9*a*-9*b* illustrate in a perspective view (FIG. 9*a*) and a side view (FIG. 9*b*) an embodiment of a corner portion of a first or a second panel.
Figure 9B:
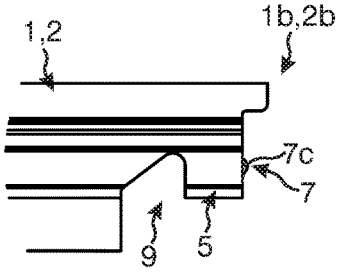
Figure 9C:
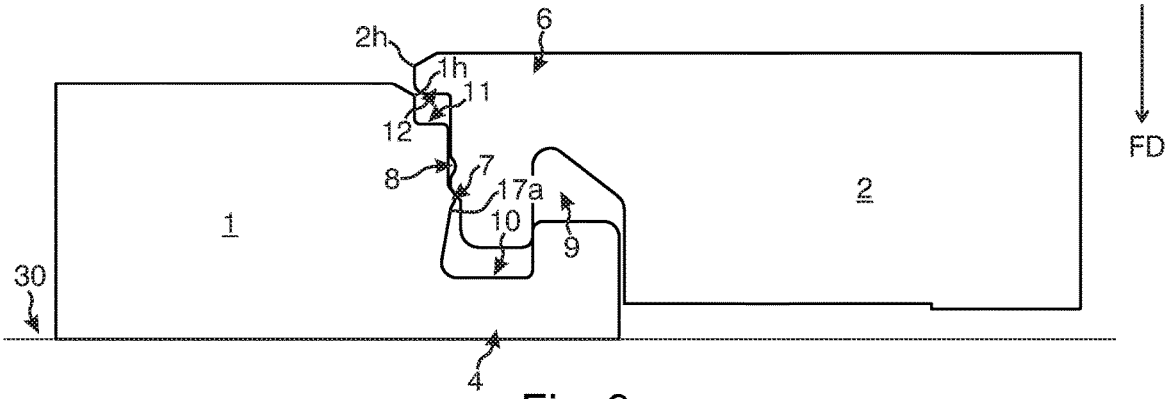
FIGS. 9*c*-9*d* illustrate in cross-sectional side views an embodiment of a joining of edge portions of a first and a second panel (FIG. 9*a*) and those panels in a locked state (FIG. 9*b*).

In some embodiments, however, the upper portions 1*e*, 2*e* may only cooperate with each other in the locked state, and may be separated from each other during at least an initial part of the joining, see, e.g., FIGS. 1*a*, 4*a* and 9*c*.

The locking member 5 may generally herein also be bendable inwards (see arrow B3) with respect to the second panel 2, cf. FIG. 1*a*. For example, the locking member 5 may be bent inwards when the protrusion 7 cooperates with the recess wall 13*a*, preferably before the locking member 5 cooperates with the locking element 3.

Figure 4B:
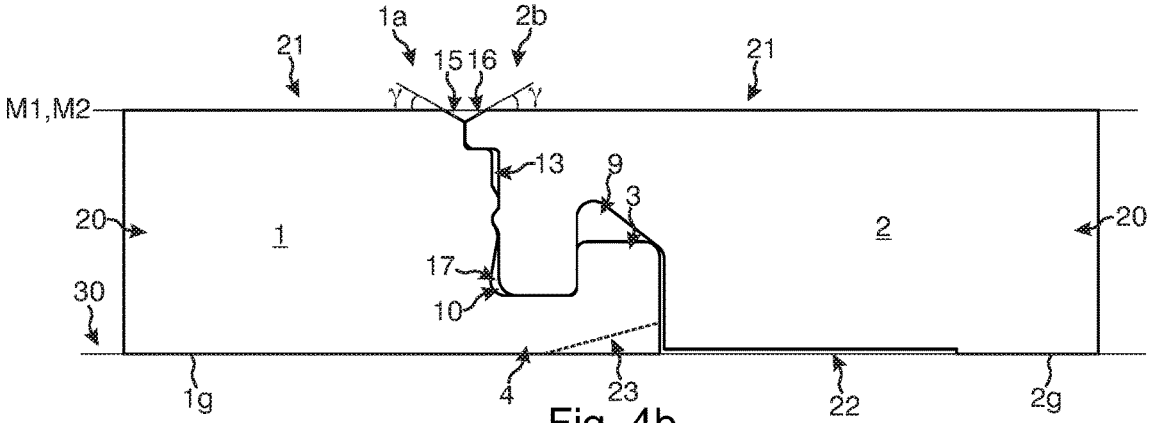

As shown in FIG. 2*c*, 4*a*-4*c*, 5*a*-5*c* and 9*c*-9*d*, the front side 1*f*, 2*f* of the first 1 and/or the second 2 panel may comprise a bevel 15, 16, preferably extending between the front side and the respective joining surface 18, 19. For example, any bevel 15, 16 herein may comprise a substantially planar surface. FIG. 4*b* illustrates that the bevel 15 and/or 16 may be disposed at an angle γ with respect to the front side 1*f* and/or 2*f*. For example, the angle γ may be 5°-50°, such as 15°-45°. In some embodiments, however, the bevel 15, 16 may be curved.

Alternatively, or additionally, to the bevel 15, 16, and as illustrated in FIGS. 1*c* and 1*n* FIG. 2*c* by the broken line, the upper portion 2*e* of the second edge portion 2*b* may comprise a lower bevel 24. The lower bevel 24 may be planar or curved, e.g., forming a radius. For example, the lower bevel 24 may extend horizontally inwards by 0.1-0.7 mm, such as 0.2-0.5 mm, from the horizontally outermost part of the upper portion 2*e*.

In any embodiment herein, there may a space S between the locking member 5 and the bottom portion 10*b* of the locking cavity 10 in the locked state, see, e.g., FIG. 2*c*. The bottom portion 10*b* may be provided in the lower strip 4 horizontally inwardly of the locking element 3. For example, at least a main part, preferably the entire, distal portion 5*b* of the locking member 5 may be separated from the bottom portion 10*b*. Hence, the space S may extend from the inner portion 3*a* to the vertical plane V2 and optionally horizontally inwardly (with respect to the first panel 1) of the outer portion 5*c* of the locking member 5, such as of the vertical plane V3.

In some embodiments, however, and as shown in FIGS. 1*b*-1*c*, 2*b*, 3*a*-3*c*, 4*b*-4*c*, 5*a*-5*c* and 9*d*, the locking member 5 may cooperate, preferably engage, with the bottom portion 10*b* in the locked state.

Hence, the vertical locking may herein be provided by two pairs of contact surfaces C1, C2, preferably corresponding to the overlapping cooperating surfaces 11*a*, 12*a* and the upper cooperating surfaces 7*a*, 8*a*, and optionally an additional pair of contact surfaces C3, preferably corresponding to the engagement between the locking member 5 and the bottom portion 10*b*. Alternatively, the vertical locking may herein be provided by two pairs of contact surfaces C2, C3, preferably corresponding to the upper cooperating surfaces 7*a*, 8*a* and the engagement between the locking member 5 and the bottom portion 10*b*, cf., e.g., FIG. 5*c*.

Optionally, and as mentioned above, the cooperation between inclined inner portions 3*a*, 5*a* may provide an additional pair of contact surfaces C4 for vertical locking, with or without a space S, cf. FIG. 5*b*.

The panels in the set may typically have a variation of the panel thickness T, which may warrant a compensating design of the locking device, especially for floor panels. For instance, the second edge portion 2*b* may in any embodiment herein comprise a calibration groove 22, preferably provided horizontally inwards of the locking groove 9, cf. FIG. 2*c*. The calibration groove 22 may be provided in the rear side 2*g* and may be open towards the locking groove 9. Moreover, it may extend along the second edge portion 2*b*, e.g., along the first horizontal direction X, such as along substantially its entirety. Preferably, the second edge portion 2*b* is resilient such that it may be bent downwards towards the subfloor 30. A, preferably maximal, depth DC of the calibrating groove 22 may be less than 0.5 mm, preferably less than 0.3 mm, such as being 0.05-0.2 mm.

Figure 4C:
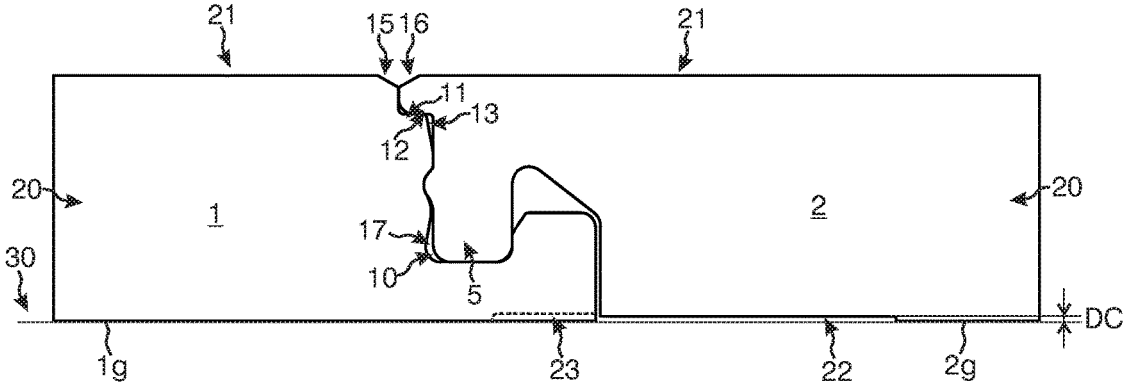
FIG. 4*c* illustrates in a cross-sectional side view an embodiment of locked edge portions of a first and a second panel.

In some embodiments, and as shown in FIG. 5*b* and FIGS. 4*a*-4*c*, including the respective broken lines (where it is understood that the part below the broken line is removed as in FIG. 5*b*), the lower strip 4 may comprise an undercut 23, such as a flexing cut, which preferably is planar. The undercut may extend at an angle $\alpha$ with respect to the rear side 1*g* and may have a horizontal extension UC. For example, a ratio UC/ES may exceed 0.5, such as being 0.6-0.8. Moreover, the undercut may extend along the first edge portion 1*a*, e.g., along the first horizontal direction X, such as along substantially its entirety. The undercut 23 may increase a resilience of the locking strip 4 and may thereby simplify the bending of the lower strip 4 downwards (see arrow B2). In FIG. 4*c*, the angle $\sigma$ is about 0° and the inner part of the undercut preferably comprises a radius. Optionally, the lower strip 4 may be biased in the locked state, preferably such that it does not return to its unlocked position.

Figure 9D:
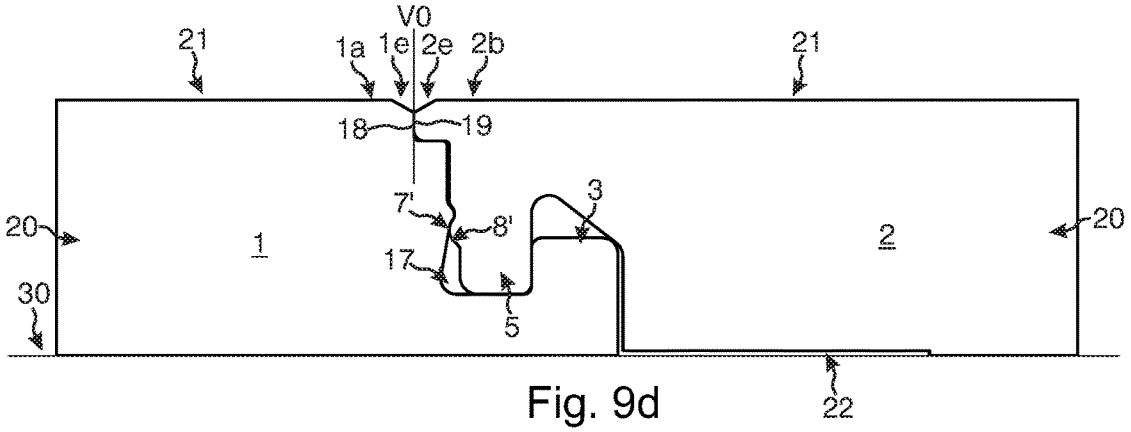

In some embodiments, as shown in FIGS. 9*c*-9*d*, the protrusion 7 may instead protrude, preferably horizontally, outwards from the first edge portion 1*a* and the groove 8 may be arranged in the second edge portion 2*b*. Such a configuration is equally conceivable for any of the embodiments described herein where the protrusion 7 protrudes outwards from the second edge portion 2*b* and the groove 8 is arranged in the first edge portion 1*a*, such as those described in FIGS. 1*a*-1*d*, 2*a*-2*c*, 3*a*-3*c*, 4*a*-4*c*, 5*a*-5*c*, 6*a*-6*c*, and 7*a*-7*d*. In fact, in some examples, and as shown in FIG. 9*c*, a supplemental protrusion 7' and a supplemental groove 8' may be formed in the second 2*b* and first 1*a* edge portion, respectively, under the groove 8 and the protrusion 7, respectively. For example, the supplemental groove 8' may at least partly be part of the recess 17, such as sharing a part of an inner wall 17*a*.

The fourth edge portion 2*d* of the second panel 2 may assume an angled joining state with respect to a third edge portion 1*c'* of a third panel 1', in which the edge portions 1*c'*, 2*d* are partially joined to each other, preferably while the second edge portion 2*b* of the second panel 2 is joined to a first edge portion 1*a* of a first panel 1 arranged on the subfloor 30, cf. FIGS. 7*a*-7*b*. Optionally, the first panel 1 is already locked to the third panel 1' along their third 1*c'* and fourth 1*d* edge portions. Preferably, the edge portions 1*c'*, 1*d*, 2*d* are long edge portions and the edge portions 1*a*, 2*b* are short edge portions.

In the angled joining state, a relative angle RA between the front sides 2*f*, 1*f* of the second 2 and third 1' panels may be smaller than a coupling angle, which for example may be 20°, such as 10° or sometimes even 8°. Alternatively, or additionally, at least two, such as three or four, pairs of contact surfaces D1, D2, D3, D4 of the further locking device in the edge portions 1*c'*, 2*d* may cooperate with each other in the angled joining state. In the angled joining state, it may be difficult, or sometimes even practically impossible, to displace the edge portions 1*c'*, 2*d* along each other, or in other words, difficult to displace the edge portions 1*a*, 2*b* with respect to each other, preferably along the second horizontal direction Y. Indeed, the resulting interacting frictional forces may become too large in the angled joining state. It may be particularly difficult for panels 1, 1', 2 comprising a core 20 of thermoplastic material, such as PVC, and a high degree, such as 50-80 wt %, of an inorganic filler.

When it is difficult to displace the edge portions 1*c'*, 2*d* along each other as explained above, it is particularly advantageous to utilize a locking device in the first 1*a* and second 2*b* edge portions allowing for a contacting and/or locking joining position. Indeed, by substantially horizontally aligning the upper portions 1*e*, 2*e*, such as along the second direction Y, before the protrusion 7 enters the groove 8, less, or even no, displacement of the second panel 2 along the fourth edge portion 2*d* may be needed for joining the edge portions 1*a*, 2*b*.

With reference to, e.g., FIGS. 6*b*-6*c*, 7*b* and 8*c*-8*f*, a first pair of contact surfaces D1 may correspond to an upper strip surface 29*a* and a bottom surface 27*b* of the tongue 27. A second pair of contact surfaces D2 may correspond to guiding surfaces 25*a*, 26*a* of the further locking element 25 and of the fourth edge portion 1*d*, 2*d*. For example, the guiding surface 25*a* may be provided in an upper and/or an inner portion of the further locking element 25 and the guiding surface 26*a* may be provided in an outer portion of the further locking groove 26 and/or an inner portion of the tongue 27, or in an intermediate segment therebetween. A third pair of contact surfaces D3 may correspond to an upper surface 27*c* of the tongue 27 and an upper surface 28*c* of the tongue groove 28. Optionally, when the further locking device further comprises a supplementary tongue 39 and supplementary tongue groove 40, a fourth pair of contact surfaces D4 may correspond to an upper surface 39*a* of the tongue 39 and an upper surface 40*a* of the tongue groove 40.

FIGS. 8*c*-8*d*, together with FIGS. 8*a*-8*b*, illustrate that in preferred embodiments, the protrusion 7 extends inwardly of the tongue 27 along the second edge portion 2*b*, such as the first horizontal direction X. For example, a longitudinally outermost portion 7*d* of the protrusion 7 along the second edge portion 2*b* may extend inwardly of the tongue 27, such as inwardly of a tip 27*a* of the tongue 27. A longitudinal end of the second edge portion 2*b* may be defined by the tip 27*a*, and the longitudinally outermost portion 7*d* may be arranged longitudinally inside of the longitudinal end of the second edge portion 2*b*. By means of a folding displacement FD, the second edge portion 2*b* is gradually vertically displaced towards the first edge portion 1*a* along the edge portions 1*a*, 2*b*, and a protrusion 7 extending inwardly of the tongue 27 may be needed in a corner portion 33 of the second panel 2, where the second 2*b* and fourth 2*d* edge portions meet. For example, this may be needed for providing cooperation between the upper portions 1*e*, 2*e* in the corner portion 33.

In some embodiments, and as shown in, e.g., FIGS. 8*c* and 9*a*, the longitudinally outermost portion 7*d* is longitudinally inside the entirety of the tongue 27.

Preferably, as shown in, e.g., FIG. 8*c*, the longitudinally outermost portion 7*d* of the protrusion 7 extends inwardly, such as being longitudinally inside, of the further locking groove 26. For example, the longitudinally outermost portion 7*d* of the protrusion 7 may extend inwardly, such as being longitudinally inside, of a corner cavity 34, such as a cut-out portion, formed in the corner portion 33. The corner cavity 34 may at least comprise the further locking groove 26 in the corner portion 33. By way of example, the corner cavity 34 may be formed by removing core material from the corner portion 33 when forming the further locking device in the fourth edge portion 1*d*, 2*d*, such as by a rotating cutting tool, preferably a jump action tool.

The protrusion 7, such as the upper cooperating surface 7*a*, may be arranged vertically below the tongue 27, such as under the bottom surface 27*b*, see FIGS. 8*c*-8*d*. Thereby, it may become easier to produce a protrusion 7 extending inwardly of the further locking groove 26. For example, when forming the further locking device of the fourth edge portion 1*d*, 2*d* by removing at least a part of the locking member 5 in the corner portion 33, the protrusion 7 may be removed at the same time.

Figure 8E:
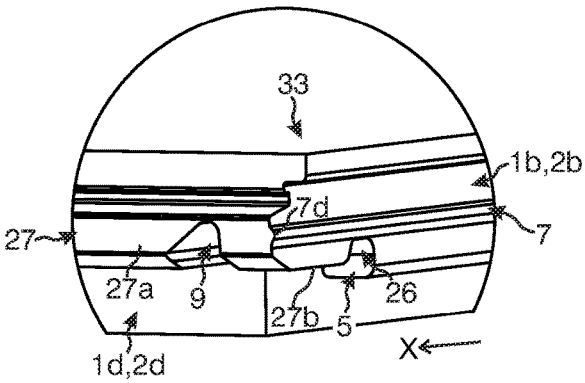
Figure 8F:
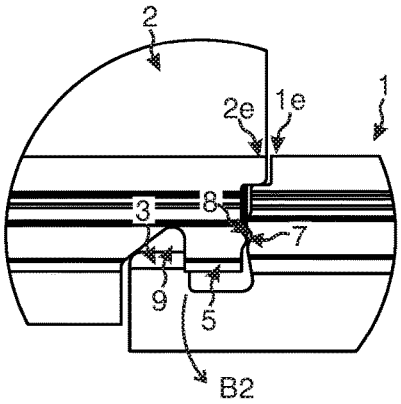

This is to be contrasted with FIGS. 8*e*-8*f*, together with FIGS. 8*a*-8*b*, illustrating that in some embodiments the protrusion 7, such as the longitudinally outermost portion 7*d*, may extend to the corner portion 33, preferably along the entire second edge portion 2*b*, such as to the tip 27*a* of the tongue 27. If so, the upper portions 1*e*, 2*e* may typically be separated from each other during an initial stage of the joining and sometimes even during the entire joining of the first 1*a* and second 2*b* edge portions by means of a folding displacement FD. The protrusion 7, for example the lower surface 7*b*, may be arranged vertically above the bottom surface 27*b* of the tongue 27, such as vertically above the further locking groove 26.

In view of the above, e.g., in relation to FIGS. 8*c*-8*d*, it is clear that the vertical locking strength of the locking device in second edge portion 1*b*, 2*b* may be reduced, or may even be absent, in the corner portion 33. FIGS. 9*a*-9*b* illustrate another embodiment in which such a vertical locking device is absent. For example, the second edge portion 1*b*, 2*b* may comprise a, preferably vertical, side wall 7*c* such that the protrusion 7 is missing from the corner portion 33. The protrusion 7 may be arranged in an inner portion 38 of the second edge portion 1*b*, 2*b* inside of the corner portion 33 and may, for example, extend along the first horizontal direction X to the further locking groove 26. In another example, the width WP may be smaller in the corner portion 33 than in the inner portion 38 such that the vertical locking strength becomes smaller in the corner portion 33, cf. FIGS. 8*e*-8*f*. For example, the width WP may become gradually smaller in an outward direction.

It is noted that the enlarged views Q1, Q2 in FIG. 8*c*-8*f* or 9*a*-9*b* are equally conceivable for any panel herein, such as for the first 1 and/or the second 2 panel.

In some embodiments, the locking device provided in the first 1*a* and second 2*b* edge portions in the form of short edge portions may provide an unsatisfactory locking function, for example by being too flexible. For example, this may occur when the panels are too resilient in a region around the edge portions 1*a*, 2*b*. Therefore, the locking device of the short edge portions may have to be complemented by a horizontal further locking device in the third 1*c*' and/or fourth 1*d*, 2*d* edge portions in the form of long edge portions. Preferably, increased frictional forces between pairs of contact surfaces D1, D2, D3, D4 of the edge portions 1*d*, 2*d*, 1*c*' may be provided, cf. FIGS. 7*a*-7*b*. Particularly large frictional forces may be obtained for contact surfaces having high frictional coefficients therebetween and/or a high surface roughness, for example obtainable in SPC panels.

Figure 7C:
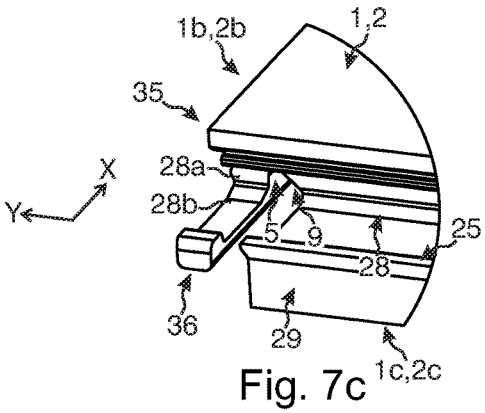
FIGS. 7*c*-7*d* illustrate in perspective views embodiments of a corner section of a first or a second panel.
Figure 7D:
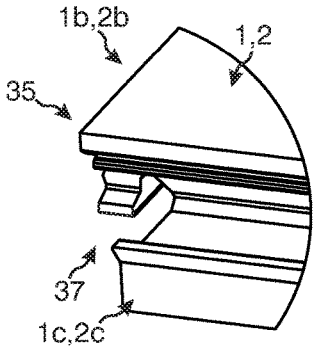

In some embodiments, and as shown in FIG. 7*c*, the forming of a locking device in the second 1*b*, 2*b* and third 1*c*, 2*c* edge portions may result in a flap 36 being formed in a corner section 35 of the panel 1, 2. The flap 36 may be an extension of the locking member 5 and may be arranged outside of the locking groove 9 along the second horizontal direction Y. The flap 36 may for many applications be too weak and may break during assembly or during packaging of the panels. Therefore, the flap 36 preferably is removed from the panel, for example by a rotating cutting device, preferably a jump action tool, or by breaking, such that the corner section 35 is provided with a corner cavity 37, see FIG. 7*d*. For example, the flap 36 may be removed outside of an inner 28*a* and/or lower 28*b* surface of the tongue groove 28 along the first horizontal direction X.

In some embodiments, and as shown in FIGS. 1*d*, 2*a* and 7*a*, an underlay element 31, such as a foam or cork, may be arranged between, and preferably in contact with, the panels 1, 2 and the subfloor 30.

Figure 6A:
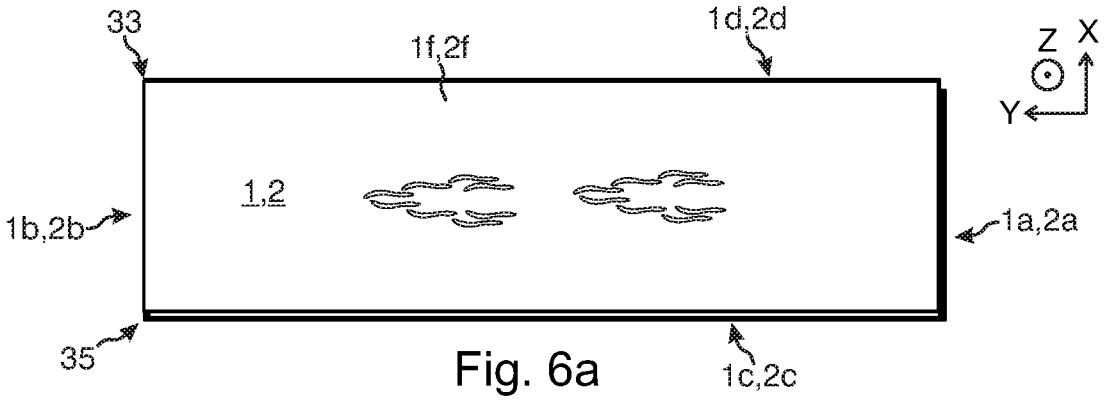
FIGS. 6*a*-6*c* illustrate in a top view (FIG. 6*a*), a side view (FIG. 6*b*), and a front view (FIG. 6*c*) an embodiment of a first or a second panel.
Figure 6B:
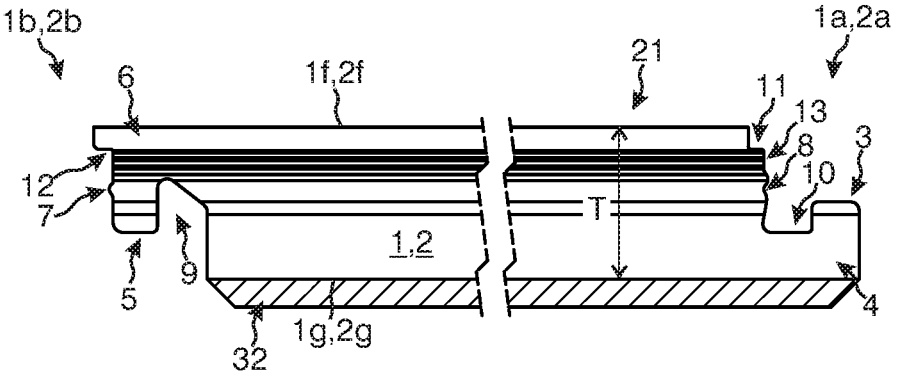

The panels 1, 2 in the set may in some embodiments comprise a pre-attached underlay member 32, such as a foam or cork, see, e.g., FIGS. 6*b*-6*c*. For example, the underlay member 32 may be bonded to the rear side 1*g*, 2*g* by means of an adhesive. The panels comprising the pre-attached underlay member 32 may be arranged directly on the subfloor 30. Preferably, an underlay member 32 is attached to a panel 1 after forming a locking device on its edge portions 1*a*, 1*b*, 1*c*, 1*d*. Thereby, the locking device may be formed in a more precise manner.

By having such an underlay element 31 or underlay member 32, at least some degree of sound dampening and/or increased comfort of the set arranged on the subfloor 30 may be provided. A density $\rho_u$ of the underlay element 31 or underlay member 32 may be lower than 80% of a density $\rho_c$ of the core 20 of the panel 1, 2, optionally being configured to be arranged in contact therewith.

Either of the underlay element 31 or underlay member 32 may be, or may comprise, a PS foam, such as extruded PS (XPS), a PE foam, such as expanded PE (EPE) or cross-linked PE foam (XLPE), a PET foam, an irradiated cross-linked PE or PP foam (IXPE foam or IXPP foam), an EVA foam, a polyolefin (PO) foam, such as cross-linked PO foam (XLPO), a foam rubber, or a cork-based underlay, such as a cork sheet.

Aspects of the disclosure have mainly been described above with reference to a few embodiments. However, as is readily appreciated by a person skilled in the art, other embodiments than the ones disclosed above are equally possible within the scope of the disclosure. For instance, it is understood that the embodiments described herein in relation to floor panels are equally conceivable for any building panel, such as wall panel. Moreover, an underlay member 32, such as that shown in FIGS. 6*b*-6*c*, may be attached to any panel described herein, for example any of those in FIGS. 1*a*-1*d*, 2*a*-2*c*, 3*a*-3*c*, 4*a*-4*c*, 5*a*-5*c*, 7*a*-7*b*, 8*a*-8*f* and 9*c*-9*d*. Conversely, it is clear to a skilled artisan that the underlay member 32 in FIGS. 6*b*-6*c* is optional and may be left out. It is finally stressed that in some embodiments, such as in any of FIGS. 1*a*-1*d*, 2*a*-2*c*, 3*a*-3*c*, 4*a*-4*c*, 5*a*-5*c*, 6*a*-6*c*, 7*a*-7*d*, 8*a*-8*f* and 9*a*-9*d*, the core 20 may comprise a thermosetting resin, preferably comprising PU, an epoxy resin, or a melamine-formaldehyde resin.

EXAMPLE

A locking configuration was tested on a first G1 and a second G2 group of samples of first and second panels in the form of SPC panels having a thickness T of 5 mm. The samples in each group G1, G2 comprised a recess and a width WP of the protrusion of was 0.2 mm. In the samples of the first group G1, the protrusion extended along the entire second edge portion to the corner portion 33 as in FIGS. 8*e*-8*f*. In the samples of the second group G2, the protrusion was missing from the corner portion 33 as in FIGS. 9*a*-9*b*. A gap size of assembled samples between uppermost portions of the edge portions 1*a*, 2*b* at the corner portions 33 was then measured by means of a profile projector. The maximal gap size of the first G1 and second G2 group was about 0.2 mm and about 0 mm, respectively. Hence, the maximal gap size of the second group G2 was found to be significantly smaller than for the first group G1.

EMBODIMENTS

Further aspects of the disclosure are provided below. Embodiments, examples, etc. of these aspects are largely analogous to the embodiments, examples, etc. as described above, whereby reference is made to the above for a detailed description.

Item 1. A set of building panels, such as floor panels, comprising a first panel (1) and a second panel (2) and a locking device for locking a first edge portion (1*a*) of the first panel to a second edge portion (2*b*) of the second panel, the first (1*a*) and second (2*b*) edge portions being configured to be joined to each other by a relative essentially vertical displacement of the first (1) and second (2) panels against each other, the locking device comprising:

a locking element (3) extending upwards from a lower strip (4) provided in the first edge portion (1*a*), and a locking member (5) extending downwards from an upper strip (6) provided in the second edge portion (2*b*), wherein the locking element (3) and the locking member (5) are configured to cooperate for horizontal locking of the first (1*a*) and second (2*b*) edge portions, and a protrusion (7) and a groove (8) arranged in the first (1*a*) and second (2*b*) edge portions, wherein the protrusion and the groove are configured to cooperate for vertical locking of the first (1*a*) and second (2*b*) edge portions, the protrusion and the groove preferably extending longitudinally along the first (1*a*) and second (2*b*) edge portions.

Item 2. The set of building panels according to item 1, wherein the protrusion (7) protrudes outwards from the second edge portion (2*b*) and the groove (8) is arranged in the first edge portion (1*a*).

Item 3. The set of building panels according to item 1 or 2, wherein a perpendicularly arranged fourth edge portion (2*d*) of the second panel (2) comprises a further locking device comprising a tongue (27) configured to cooperate with a tongue groove (28) of an adjacent panel (1') for vertical locking, wherein a longitudinal end of the second edge portion (2*b*) is defined by a tip (27*a*) of the tongue (27), and wherein a longitudinally outermost portion (7*d*) of the protrusion (7) extending inwardly of the tongue (27) in a direction along the second edge portion (2*b*), such as being longitudinally inside of the longitudinal end of the second edge portion (2*b*), preferably in a locked and/or an unlocked state of the first (1) and second (2) panels.

Item 4. The set of building panels according to item 2 or 3, wherein a perpendicularly arranged fourth edge portion (2*d*) of the second panel (2) comprises a further locking device comprising a further locking groove (26) configured to cooperate with a further locking element (25) provided on a further strip (29) of an adjacent panel (1') for horizontal locking, a longitudinally outermost portion (7*d*) of the protrusion (7) extending inwardly, such as being longitudinally inside, of the further locking groove (26) in a direction along the second edge portion (2*b*).

Item 5. The set of floor panels according to any of the preceding items, wherein the second edge portion (2*b*) comprises a, preferably vertical, side wall (7*c*) such that the protrusion (7) is missing from a corner portion (33) of the second panel (2), where the second (2*b*) and fourth (2*d*) edge portions meet.

Item 6. The set of building panels according to any of the preceding items 2-5, wherein a perpendicularly arranged fourth edge portion (2*d*) of the second panel (2) comprises a further locking device comprising a tongue (27) configured to cooperate with a tongue groove (28) of an adjacent panel (1') for vertical locking, the protrusion (7) being arranged vertically below the tongue (27), such as under a bottom surface (27*b*) thereof.

Item 7. The set of building panels according to any of the preceding items, wherein the protrusion (7) is integrally formed with the second edge portion (2*b*).

Item 8. The set of building panels according to any of the preceding items, wherein the locking member (5) is resilient.

Item 9. The set of building panels according to any of the preceding items, wherein, during joining, the first (1) and second (2) panels are configured to assume a contacting joining position in which upper portions (1*e*; 2*e*) of the first (1*a*) and second (2*b*) edge portions cooperate with each other while the protrusion (7) is located vertically above the groove (8).

Item 10. The set of building panels according to item 9, wherein, during joining, the first (1) and second (2) panels are configured to assume a contacting joining position in which the upper portion (2*e*) of the second edge portion (2*b*) cooperates with an uppermost portion (1*h*) of the first edge portion (1*a*) while the protrusion (7) is located vertically above the groove (8).

Item 11. The set of building panels according to any of the preceding items, wherein, during joining, the first (1) and second (2) panels are configured to assume a locking joining position in which upper portions (1*e*; 2*e*) of the first (1*a*) and second (2*b*) edge portions cooperate with each other while simultaneously, preferably inner portions (3*a*; 5*a*) of, the locking element (3) and the locking member (5) cooperate with each other.

Item 12. The set of building panels according to item 11, wherein, during joining, the first (1) and second (2) panels are configured to assume a locking joining position in which the upper portion (2*e*) of the second edge portion (2*b*) cooperates with an uppermost portion (1*h*) of the first edge portion (1*a*) while simultaneously, preferably inner portions (3*a*; 5*a*) of, the locking element (3) and the locking member (5) cooperate with each other.

Item 13. The set of building panels according to any of the preceding items, wherein an inner portion (3*a*) of the locking element (3) comprises a chamfer (14).

Item 14. The set of building panels according to any of the preceding items, wherein the locking element (3) is configured to be arranged in a locking groove (9) provided in the second edge portion (2*b*) and/or wherein the locking member (5) is configured to be arranged in a locking cavity (10) provided in the first edge portion (1*a*).

Item 15. The set of building panels according to item 14, wherein the protrusion (7) is arranged below an innermost portion (9*b*) of the locking groove (9).

Item 16. The set of building panels according to item 14 or 15, wherein a depth (DG) of the locking groove (9) increases in a direction towards an outermost portion of the second edge portion (2*b*).

Item 17. The set of building panels according to any of items 14 to 16, wherein the locking cavity (10) comprises a recess (17) for accommodating the locking member (5) during joining of the first (1*a*) and second (2*b*) edge portions.

Item 18. The set of building panels according to any of items 14 to 17, wherein there is a space (S) between the locking member (5) and a bottom portion (10*b*) of the locking cavity (10) in a locked state of the first (1) and second (2) panels.

Item 19. The set of building panels according to any of items 14 to 18, wherein the locking member (5) cooperates with a bottom portion (10*b*) of the locking cavity (10) in a locked state of the first (1) and second (2) panels.

Item 20. The set of building panels according to any of the preceding items, wherein the lower strip (4) is resilient such that it is bendable downwards during joining of the first (1*a*) and second (2*b*) edge portions.

Item 21. The set of building panels according to any of the preceding items, wherein a ratio between an extension (ES) of the lower strip (4) and a panel thickness (T) of the first panel (1) is in the range of 1:2.5 to 1.8:1, preferably 1:1.8 to 1.8:1.

Item 22. The set of building panels according to any of the preceding items, wherein the protrusion (7) and groove (8) cooperate at upper cooperating surfaces (7*a*; 8*a*) of the protrusion (7) and groove (8) in a locked state of the first (1) and second (2) panels, and wherein lower surfaces (7*b*; 8*b*) of the protrusion (7) and groove (8) preferably are separated from each other.

Item 23. The set of building panels according to any of the preceding items, wherein an upper cooperating surface (7*a*; 8*a*) of the protrusion (7) and/or the groove (8) forms a locking angle ($\alpha$) of 0°-45° with respect to a second horizontal direction (Y) extending in parallel with a front (1*f*; 2*f*) and/or rear side (1*g*; 2*g*) of the panels.

Item 24. The set of building panels according to any of the preceding items, wherein upper portions (1*e*; 2*e*) of the first (1*a*) and second (2*b*) edge portions comprise a shelf portion (11) and a lap portion (12), respectively, configured to cooperate with each other at overlapping cooperating surfaces (11*a*; 12*a*).

Item 25. The set of building panels according to item 24, wherein the shelf portion (11) comprises a shelf recess (13) for housing at least a portion of the protrusion (7) during joining of the first (1*a*) and second (2*b*) edge portions.

Item 26. The set of building panels according to any of the preceding items, wherein a front side (1*f*; 2*f*) of the first (1) and/or the second (2) panel comprises a bevel (15; 16).

Item 27. The set of building panels according to any of the preceding items, wherein the second edge portion (2*b*) comprises a calibration groove (22).

Item 28. The set of building panels according to any of the preceding items, wherein the first (1*a*) and second (2*b*) edge portions are short edge portions.

Item 29. The set of building panels according to any of the preceding items, wherein the horizontal locking is further provided by upper portions (1*e*; 2*e*) of the first (1*a*) and second (2*b*) edge portions cooperating with each other.

Item 30. The set of building panels according to any of the preceding items, wherein a core (20) of the first (1) and second (2) panel comprises a thermoplastic material, such as PVC, and an inorganic filler.

The invention claimed is:

1. A set of building panels comprising a first panel and a second panel and a locking device for locking a first edge portion of the first panel to a second edge portion of the second panel, the first and second edge portions being configured to be joined to each other by a relative essentially vertical displacement of the first and second panels against each other, the locking device comprising:

a locking element extending upwards from a lower strip provided in the first edge portion, and a locking member extending downwards from an upper strip provided in the second edge portion, wherein the locking element and the locking member are configured to cooperate for horizontal locking of the first and second edge portions, and a protrusion and a groove arranged in the first and second edge portions, wherein the protrusion and the groove are configured to cooperate for vertical locking of the first and second edge portions, wherein the protrusion protrudes outwards from the second edge portion and the groove is arranged in the first edge portion, and wherein a perpendicularly arranged fourth edge portion of the second panel comprises a further locking device comprising a tongue configured to cooperate with a tongue groove of an adjacent panel for vertical locking, wherein the protrusion extends longitudinally along the second edge portion, wherein a longitudinal end of the second edge portion is defined by a tip of the tongue, wherein a longitudinally outermost portion of the protrusion is longitudinally inside of the longitudinal end of the second edge portion, and wherein the further locking device comprising a further locking groove configured to cooperate with a further locking element provided on a further strip of an adjacent panel for horizontal locking, the longitudinally outermost portion of the protrusion being longitudinally inside of the further locking groove in the direction along the second edge portion.

2. The set of building panels according to claim 1, wherein the longitudinally outermost portion of the protrusion is longitudinally inside the entirety of the tongue.

3. The set of building panels according to claim 1, wherein the protrusion is arranged vertically below the tongue.

4. The set of building panels according to claim 1, wherein the second edge portion comprises a side wall such that the protrusion is missing from a corner portion of the second panel, where the second and fourth edge portions meet.

5. The set of building panels according to claim 4, wherein the side wall is vertical.

6. The set of building panels according to claim 1, wherein the locking element is configured to be arranged in a locking groove provided in the second edge portion, the protrusion being arranged below an innermost portion of the locking groove.

7. The set of building panels according to claim 1, wherein the locking element is configured to be arranged in a locking groove provided in the second edge portion, a depth of the locking groove increasing in a direction towards an outermost portion of the second edge portion.

8. The set of building panels according to claim 1, wherein the locking member is configured to be arranged in a locking cavity provided in the first edge portion, the locking cavity comprising a recess for accommodating the locking member during joining of the first and second edge portions.

9. The set of building panels according to claim 1, wherein the lower strip is resilient such that it is bendable downwards during joining of the first and second edge portions.

10. The set of building panels according to claim 1, wherein the protrusion and groove cooperate at upper cooperating surfaces of the protrusion and groove in a locked state of the first and second panels, and wherein lower surfaces of the protrusion and groove are at least partially separated from each other.

11. The set of building panels according to claim 1, wherein the protrusion is integrally formed with the second edge portion.

12. The set of building panels according to claim 1, wherein there is a space between the locking member and a bottom portion of the locking cavity in a locked state of the first and second panels.

13. The set of building panels according to claim 1, wherein an upper cooperating surface of the protrusion and/or the groove forms a locking angle of 0°-45° with respect to a second horizontal direction extending in parallel with a front and/or rear side of the panels.

14. The set of building panels according to claim 1, wherein upper portions of the first and second edge portions comprise a shelf portion and a lap portion, respectively, configured to cooperate with each other at overlapping cooperating surfaces.

15. The set of building panels according to claim 14, wherein the shelf portion comprises a shelf recess for housing at least a portion of the protrusion during joining of the first and second edge portions.

16. The set of building panels according to claim 1, wherein a core of the first and second panel comprises a thermoplastic material and an inorganic filler.

17. The set of building panels according to claim 1, wherein the tongue is free of any portion of the protrusion.

18. A set of building panels comprising a first panel and a second panel and a locking device for locking a first edge portion of the first panel to a second edge portion of the second panel, the first and second edge portions being configured to be joined to each other by a relative essentially vertical displacement of the first and second panels against each other, the locking device comprising:

a locking element extending upwards from a lower strip provided in the first edge portion, and a locking member extending downwards from an upper strip provided in the second edge portion, wherein the locking element and the locking member are configured to cooperate for horizontal locking of the first and second edge portions, and a protrusion and a groove arranged in the first and second edge portions, wherein the protrusion and the groove are configured to cooperate for vertical locking of the first and second edge portions, wherein the protrusion protrudes outwards from the second edge portion and the groove is arranged in the first edge portion, and wherein a perpendicularly arranged fourth edge portion of the second panel comprises a further locking device comprising a tongue configured to cooperate with a tongue groove of an adjacent panel for vertical locking, wherein the protrusion extends longitudinally along the second edge portion, wherein a longitudinal end of the second edge portion is defined by a tip of the tongue, wherein a longitudinally outermost portion of the protrusion is longitudinally inside of the longitudinal end of the second edge portion, and wherein the protrusion is arranged vertically under a bottom surface of the tongue.

* * * * *